US008360631B2

(12) United States Patent
Melnyczuk

(10) Patent No.: US 8,360,631 B2
(45) Date of Patent: Jan. 29, 2013

(54) METHOD AND APPARATUS FOR THE PREPARATION OF A RECONSTITUTED FOOD PRODUCT

(75) Inventor: Michaelo Peter Melnyczuk, Stellenbosch (ZA)

(73) Assignee: Rex Food Technologies (Pty) Ltd, Newlands (ZA)

( * ) Notice: Subject to any disclaimer, the term of this patent is extended or adjusted under 35 U.S.C. 154(b) by 830 days.

(21) Appl. No.: 12/441,452

(22) PCT Filed: Sep. 17, 2007

(86) PCT No.: PCT/IB2007/053749

§ 371 (c)(1),
(2), (4) Date: Aug. 18, 2009

(87) PCT Pub. No.: WO2008/032295

PCT Pub. Date: Mar. 20, 2008

(65) Prior Publication Data

US 2010/0003391 A1 Jan. 7, 2010

(30) Foreign Application Priority Data

Sep. 15, 2006 (ZA) ..... 2006/07723

(51) Int. Cl.
*B01F 5/06* (2006.01)

(52) U.S. Cl. ..... 366/337

(58) Field of Classification Search ..... 366/336, 366/337, 338, 339

See application file for complete search history.

(56) References Cited

U.S. PATENT DOCUMENTS

| | | | | | |
|---|---|---|---|---|---|
| 3,051,452 | A | * | 8/1962 | Nobel | 366/337 |
| 3,239,197 | A | * | 3/1966 | Tollar | 366/337 |
| 4,164,375 | A | * | 8/1979 | Allen | 366/337 |
| 4,461,579 | A | * | 7/1984 | McCallum | 366/337 |
| 4,806,288 | A | * | 2/1989 | Nowosinski et al. | 261/94 |
| 5,992,465 | A | * | 11/1999 | Jansen | 138/37 |

FOREIGN PATENT DOCUMENTS

| | | |
|---|---|---|
| DE | 23 43 352 A1 | 3/1975 |
| EP | 1 312 409 A1 | 5/2003 |
| FR | 2 406 151 A1 | 5/1979 |

* cited by examiner

*Primary Examiner* — Tony G Soohoo

(74) *Attorney, Agent, or Firm* — Connolly Bove Lodge & Hutz LLP

(57) ABSTRACT

A method and apparatus are provided for producing a reconstituted food product. The apparatus includes a co-extruder 11 in which a gelling agent 70 and a setting agent 80 are co-extruded into a process stream of comminuted food pieces in a flow passage, with the gelling agent and setting agent being separated by the process stream. The apparatus includes a static mixer 10 of part cylindrical wall elements 22 with inwardly protruding mixer elements 24 in which the process stream, including the gelling agent and setting agent are mixed and the grain and texture of the food pieces altered to produce a reconstituted food product that resembles whole food. The apparatus includes a tenderiser 200 for pre-treating the comminuted food pieces by compressing them between a stationary plate 202 and a vibrating plate 206 in a tapering cavity.

15 Claims, 16 Drawing Sheets

Fig 5C
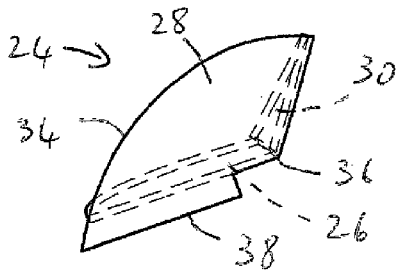
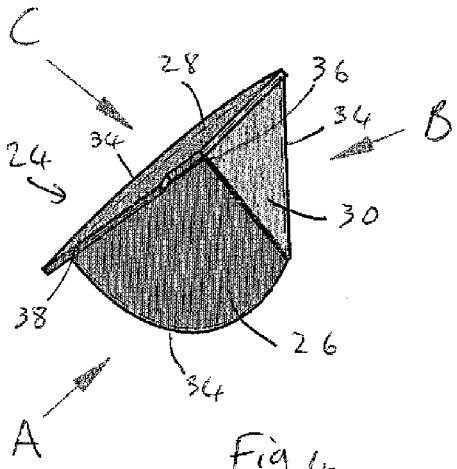
Fig 4
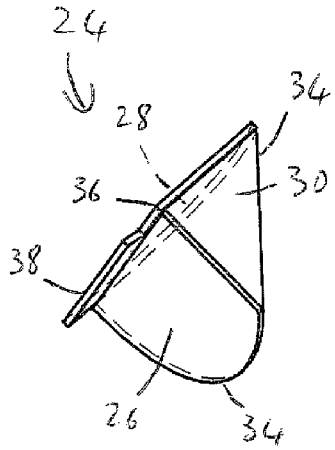
Fig 5B
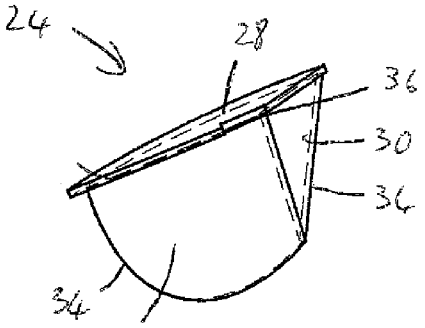
Fig 5A

Fig 12
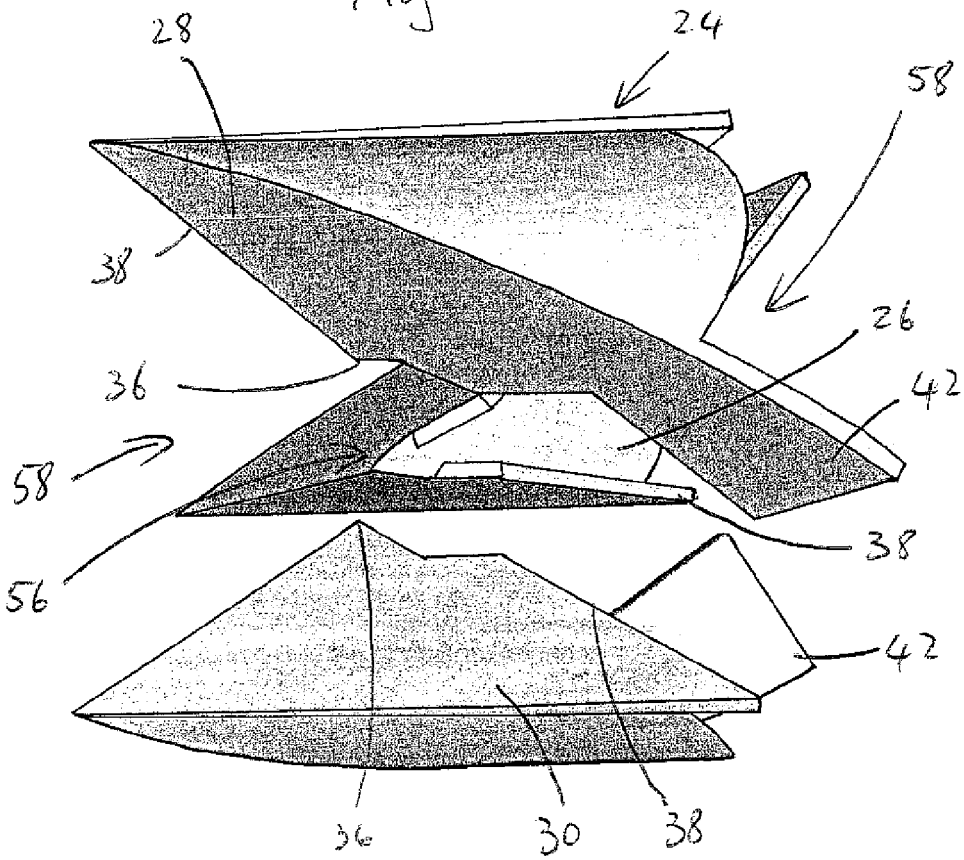
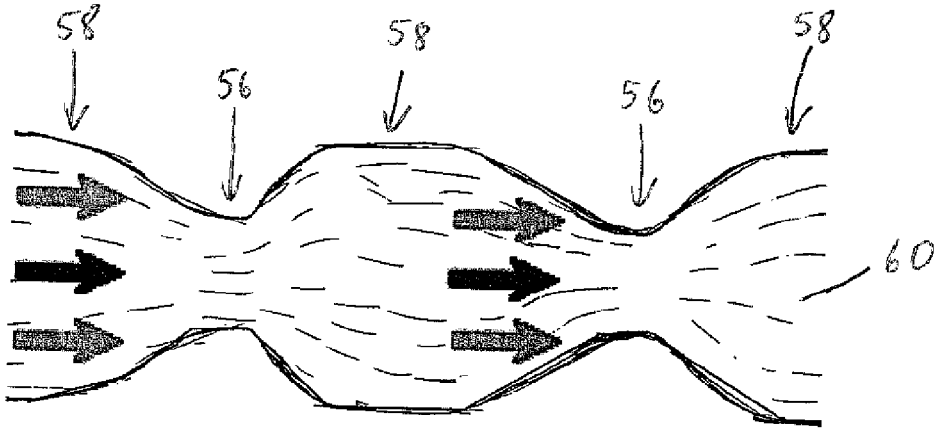
Fig 13

METHOD AND APPARATUS FOR THE PREPARATION OF A RECONSTITUTED FOOD PRODUCT

CROSS REFERENCE TO RELATED APPLICATIONS

This application is a national phase of PCT/IB2007/053749, filed on Sep. 17, 2007, which claims priority to ZA 2006/07723, filed on Sep. 15, 2006, the entire contents of which are incorporated herein by reference in their entireties.

FIELD OF THE INVENTION

This invention relates to food processing and in particular, it relates to a static mixer, additive dispensing and tenderising that is useful in the production of a reconstituted food product, although its use is not limited to this particular application.

BACKGROUND TO THE INVENTION

In many food processing operations, pieces of foods are produced that are regarded as being less valuable than other, typically larger pieces. Further, some food pieces can be produced that are less valuable than others, simply as a result of their qualities, e.g. some cuts of meat are less desirable than others because they are too tough.

A number of methods have been developed to produce reconstituted food products from such lower value food pieces, where the reconstituted food products have sizes and properties that make them more valuable than the lower value food pieces. Reconstitution is typically achieved by comminuting the food pieces and combining them with additives that will bind them together. The methods and recipes for producing reconstituted food products vary greatly, but typical examples are corned beef, sausages, and the like.

While existing methods of preparing reconstituted food products generally do not attempt to provide such a product, it would be greatly beneficial if a reconstitution process can provide a food product that resembles an unprocessed high value food product, e.g. if lower value cuts of meat, off-cuts, etc. can be processed to provide a food product that resembles a whole muscle of preferred cut of high quality meat.

Processes have been proposed for preparing such a reconstituted food product, e.g. in International Patent Application No. WO 2004/008876 (to Melnyczuk), the content of which is included herein in its entirety, by reference. However, existing food processing equipment and techniques are prone to a number of deficiencies which make them unsuitable for the preparation of a reconstituted food product as described above. In order to prepare a reconstituted food product as described above from food pieces, the pieces need to be combined with additives to bind them and to impart other desired characteristics to them, such as consistency and texture. These additives need to be evenly distributed in the process stream of food pieces to impart these characteristics evenly and this should be done before the additives react to bind the food pieces. Further, in order to provide a reconstituted food product that resembles a whole, high quality product, the food pieces also need to be processed to homogenise them while maintaining their structure and texture, produce a desired grain structure, etc. It has been proposed in WO 2004/008876 that this be done in a static mixer, but none of the prior art static mixers are particularly suitable for mixing these food pieces and additives, especially where the food pieces include elongate fibres or strands that have a tendency to catch on food processing equipment.

The term "static mixers" refers to a wide variety of devices that usually comprise an insert that is placed inside a tube through which a liquid, gel, paste or the like, flows. The purpose of the insert is typically to mix the flowing material to homogenise it, although it can also serve ancillary purposes such as agitation, comminution, etc.

Examples of static mixers of this type, are disclosed in U.S. Pat. Nos. 5,425,581 (to Palm) and 7,040,802 (to Füglister), which include mixer inserts that are received inside cylindrical tubes. However, when mixers are used in applications where they need to be cleaned regularly, such as in the food processing industry, and where aggressive mixing is required, such as in the processing of meat products, these configurations are not ideal, since the intricate geometries of the inserts make them difficult and/or costly to clean regularly, even when they have been removed from the cylindrical tubes.

An improved static mixer has been disclosed in WO 2004/008876, in which the elements that cause the mixing are in the form of blades that are fixedly attached to walling elements and the walling elements are positioned side-by-side to form the tube through which the material flows. This improvement allows the mixer to be disassembled very easily to a state in which its components can be cleaned easily and effectively. However, this mixer holds the disadvantages that the flow of material immediately downstream of the blades tends to stagnate in some instances and in some instances, inadequate mixing occurs largely because some of the material can pass between the blades along a three dimensional zigzag-like passage, rather than being adequately folded within the mixer.

Other deficiencies of existing food processing equipment relate to an inability to ensure even distribution of the additives in the food pieces in a continuous process that can be stopped and re-started relatively easily. The result of uneven distribution of additives is that some parts of the reconstituted food product will receive too much additive and thus set too firmly, while other parts will receive an insufficient dosage of one or more additives and thus either remain too soft, or not set at all. Preferably, the setting of food product inside processing equipment when the process is stopped, should be avoided or kept to a minimum, since the set or partially set food product will either need to be removed before the process can be re-started, or will disrupt product consistency.

Some methods of preparing reconstituted food products are carried out in batches in which the additives are added to the food pieces and they are thoroughly mixed and processed, e.g. as described in U.S. Pat. No. 4,603,054. However, the entire batch of the food pieces is brought into contact with the additives at the same time, which causes setting to begin, but the batch is processed further over a length of time and the degree of setting that has taken place in food pieces when they proceed to further processing varies.

One way to address this problem is by keeping batch sizes small so that the batch can be processed relatively promptly to minimise the variance during the course of processing, in the degree of setting that takes place. Production in small batches, in which the equipment has to be cleared of partially or fully set reconstituted product after each batch, is not cost effective.

Another way of addressing this problem is to add buffering agents to the food mixture to delay setting, e.g. to provide a typical window period of twelve hours. However, the use of buffering agents may require larger quantities of setting agents in the mixture, which could lead to secondary sineresis, especially if there is incorrect or inadequate mixing. During the window period, the mixture needs to be stored, which requires additional handling and storage facilities, which typically needs to be refrigerated. The likelihood of contamination of the food product is also typically increased during the additional handling and storage.

Continuous methods can be used for the production of reconstituted food products and examples of existing methods are provided in U.S. Pat. No. 5,783,241 and in WO 2004/008876, in which the gelling agents and setting agents are added to a product stream. However, as mentioned above, unless a buffering agent is used, setting commences as soon as the gelling agent and setting agent come into contact with each other and in existing processes, this occurs at some stage before the food product stream is finally processed. In particular, in WO 2004/008876, the additives are added to the process stream together, upstream of the static mixer and setting commences before the product stream is processed in the mixer. This has two disadvantages, the first being that it causes excessive setting of the product before or during mixing, that increases the energy requirement of the mixing process and reduces the effectiveness of the mixing process. The second disadvantage is that, in the event of a process stoppage, the mixture of gelling agent, setting agent and food pieces upstream of the static mixer will set and will need to be removed before the process can be re-started.

In some instances, especially if food pieces in the form of relatively tough meat is used, it is preferable to pre-treat the food pieces in a tenderiser, in order to increase the surface area of the food pieces that is exposed to additives and thus improve cohesion during setting, to reduce the size of inconsistencies in the food pieces, to provide a more natural looking grain, to achieve desired tenderness characteristics, to impart a texture to the food pieces that makes them more workable in the reconstitution process, and the like. However, existing tenderisers have been found not to perform adequately.

Existing methods of tenderising foods typically include percussive methods such as pounding with a mallet, penetrating methods in which needles or blades penetrate the food and tenderisers passing foods through counter rotating rollers or gears, such as that disclosed in European Patent No. EP 0930015 (to Bonon et al). Percussive tenderising is too time consuming to be used effectively on an industrial scale and penetrating methods of tenderising are not sufficiently effective in flattening food pieces while maintaining its fibre structure largely intact, as is preferable in pre-treatment for reconstitution of a food product, as described above. It is often difficult to control or adjust the extent of tenderisation in some roller/gear type tenderisers, with the result that the tenderised food pieces often lack the desired consistency and/or texture.

The tenderiser of EP 0930015 would impart most of the required characteristics to the food pieces, but has a number of disadvantages for use in pre-treatment of food pieces before reconstitution. In particular, food pieces are often not pulled into the gap between the rollers and simply roll around on top of the rollers. The use of this type of tenderiser also requires preparation of the food pieces before tenderising, e.g. by slicing the food in a particular way, that is cumbersome and/or costly. Further, the tenderiser of EP 0930015 is not well suited to tenderising pre-frozen meat, which can be very inhibiting since many bulk manufacturers prefer to use meat that can be sourced and stored frozen.

The reason for the unsuitability of the EP 0930015 tenderiser results largely from the dehydration of meat during freezing and defrosting, which causes the meat surface to be watery, resulting in meat pieces that are slippery and often do not pass through the rollers, but slide around on top of the rollers. Further, if a vacuum filler is used, the removal of unbound water from the defrosted meat causes a loss in mass and thus value and causes a loss in the lubricating effect of the moisture, thus making the meat pieces difficult to pump. A water binder can be added to the meat to compensate for the loss of lubrication and for ease of processing (relating to distribution of the gel and reduction of meat handling). This should preferably be done before the meat is tenderised, but the water binder causes the meat surfaces to be even more slippery and exacerbates the problem of meat pieces sliding around on top of the rollers. Further, the addition of a water binder causes the meat to stick to the rollers after the tenderisation and not to be removed entirely by the scrapers, especially in the event that the rollers have surface features on them (e.g. ridges, grooves or teeth). It is preferable that slices of meat are fed into the EP 0930015 tenderiser, rather than cubes, but it is difficult to cover slices evenly with a water binder.

The EP 0930015 tenderiser is also unsuitable for use in reconstitution, since it cannot be used for tenderising meat with a wide variety of characteristics, as is often the case in the typical supplies of meat for reconstitution. The tenderiser itself is large, but the process is slow, since only a few pieces of meat can be fed through at a time.

The present invention seeks to provide for the manufacturing of reconstituted food products, overcoming the drawbacks in the prior art. In particular, the present invention seeks to provide a static mixer that can impart adequate mixing to the material flowing through the mixer, while adequately maintaining the structure and texture of the material and that can be cleaned with relative ease and efficiency. The present invention also seeks to provide for continuous dosing, mixing, shaping and setting at a constant speed to provide a reconstituted food product with a consistent texture and cohesion, even if the manufacturing process is interrupted from time to time. The present invention further seeks to provide for tenderising of food pieces, prior to manufacturing of reconstituted food products.

SUMMARY OF THE INVENTION

According to a first aspect of the present invention there is provided a static mixer comprising:

- a plurality of wall elements, the wall elements being shaped and configured such that they define an internal passage, when placed in a side-by-side arrangement, said passage defining an inlet, an outlet and a flow path extending from the inlet, downstream towards the outlet; and
- a plurality of mixer elements, each attachable to the inside of one of the walling elements to protrude into the passage, each mixer element defining at least one leading surface facing towards the inlet of the passage and at least one trailing surface facing towards the outlet of the passage, each of the leading and trailing surfaces having a root where it meets the inside of the wall element to which it is attached and an apex, opposite from its root;
- wherein the leading surface and the trailing surface intersect at an angle greater than zero degrees.

At least some, but preferably each of the leading surfaces and/or trailing surfaces may intersect the inside of the wall element to which the element is attached, at an obtuse angle At least some, but preferably each mixer element may define a third surface extending in the direction of the flow path, so that the mixer element may have a three-dimensional triangular pyramid shape. The third surface and/or a fourth surface may be generally aligned with a lateral edge of the wall element to which the mixer element is attachable.

The leading surface and third surface of at least some of the mixer elements may intersect at an angle, preferably an acute angle, to form a sharp leading edge, facing towards the inlet of the passage.

At least one, but preferably two ridges may be defined along edges of the leading surface of at least some of the mixer elements, extending generally from its root in the direction of its apex, and the ridges may stop short of the apex to form an apex gap between them. The ridges may extend in a co-planar manner from the trailing surface and/or from the third surface. In a preferred embodiment, the leading surface may be generally triangularly shaped and the two ridges may converge towards the apex gap.

The mixer elements may be oriented such that the apex gaps of some mixer elements are immediately upstream of the leading surfaces of other mixer elements.

The invention extends to a method of treating food in a static mixer as described hereinabove, said method comprising passing a process stream along the internal passage of the mixer.

The method may include sliding part of the process stream along the leading surface of a mixer element and compressing it between two converging ridges of the mixing element, before passing the compressed part of the process stream at least partly through the apex gap.

The method may include changing the direction of part of the process stream or folding it as it flows from the apex gap, by passing it over a leading surface of a mixer element immediately downstream.

The method may include cleaving part of the process stream by passing it over a leading edge of a mixer element or a ridge extending from an edge of a leading surface.

According to another aspect of the present invention, there is provided a food tenderiser comprising:

a first body defining a first tenderising surface; and a second body defining a second tenderising surface, facing the first tenderising surface with regions of the tenderising surfaces at an inlet of the tenderiser being spaced apart and with regions of the tenderising surfaces at a discharge of the tenderiser being in close proximity, defining a tapering tenderising cavity between the tenderising surfaces and defining a narrow gap between them at the discharge of the tenderiser;

wherein said tenderiser includes vibrator means for vibrating the first body relative to the second body.

The tenderiser may include vibrator means for vibrating the second body relative to the first body and the vibrator means may include an eccentric rotateable mass.

The inlet of the tenderiser may be at a higher elevation than the discharge of the tenderiser, i.e. the tenderiser may be oriented for gravity feed.

The tenderiser may define complementary longitudinal formations on the first and second tenderising surfaces such as ribs and grooves, undulations, or the like and the tenderiser may define hook formations on one or both of the tenderising surfaces, that are directed towards the discharge of the tenderiser, to restrain movement of food inside the tenderising cavity from moving towards the inlet.

According to a further aspect of the present invention there is provided a method of tenderising food, said method comprising:

feeding the food from an inlet of a tenderiser into a tapering tenderising cavity between two tenderising surfaces; and allowing the food to pass towards the narrow end of the tapering cavity through a narrow gap at the discharge of the tenderiser, while compressing the food;

wherein the method includes vibrating at least one of the tenderising surfaces relative to the other.

The method may include vibrating the tenderising surface in generally elliptical motions to drive the food towards the tenderiser's discharge. In this regard, the term "elliptical" is intended to include circular motion or any other similar motion. In addition, the method may include allowing the food to pass from the inlet towards the discharge of the tenderiser under gravity.

The method may include elongating the food along at least one dimension as it passes through the narrow gap, as a result of the flattening of the food and the elongate shape of the narrow gap at the discharge of the tenderiser.

The method may include retaining the food inside the tenderising cavity against passing towards the inlet of the tenderiser, by engaging the food with a plurality of hook formations on one or both of the tenderising surfaces.

According to yet a further aspect of the present invention there is provided a method for the production of a reconstituted food product, said method comprising:

providing a process stream of food pieces;

dispensing a gelling agent into the process stream at a first region of the process stream;

dispensing a setting agent into the process stream at a second region of the process stream; and mixing the process stream comprising the food pieces, gelling agent and setting agent;

wherein the first region and the second region in the process stream are separated by the food pieces in the process stream, such that the gelling agent and the setting agent remain separate until the process stream is mixed.

The second region of the process stream may be internal of said process stream and may be at a substantially central region of the process stream, whereas the first region of the process stream may be at the periphery of the process stream.

The method may include dispensing the gelling agent into the process stream at the first region before dispensing the setting agent into the process stream at the second region and may include a further step of dispensing a setting agent at the periphery of the process stream after mixing the process stream.

The method may include mixing the process stream in a static mixer, e.g. the static mixer may be a static mixer as described herein above. The method may also include a prior step of tenderising the food pieces of the process stream, e.g. the food pieces may be tenderised in a tenderiser as disclosed herein.

According to yet a further aspect of the present invention there is provided apparatus for the production of a reconstituted food product, said apparatus comprising:

a reconstitution passage having an inlet that is connectable to a supply into the reconstitution passage, of a process stream of food pieces;

a gelling agent dispenser that is connectable to a supply of gelling agent and that has a discharge opening at a first region of the reconstitution passage;

a setting agent dispenser that is connectable to a supply of setting agent and that has a discharge opening at a second region of the reconstitution passage; and a mixer in communication in the reconstitution passage;

wherein the first region and the second region in the reconstitution passage are spaced apart.

The second region of the reconstitution passage may be internal of the reconstitution passage and may be at a substantially central region of the reconstitution passage, whereas the first region of the reconstitution passage may be at the periphery of the reconstitution passage.

The setting agent dispenser may include a duct extending substantially parallel to the reconstitution passage, towards its discharge opening, that faces downstream.

The gelling agent dispenser may include an inlet chamber defining a striction zone so that the inlet chamber is in flow communication with the reconstitution passage via the striction zone.

The discharge opening of the gelling agent dispenser may be closer to the inlet of the reconstitution passage than the discharge opening of the setting agent dispenser, i.e. the discharge opening of the gelling agent dispenser may be upstream from the discharge opening of the setting agent dispenser.

The apparatus may further include an external setting agent dispenser that is disposed on a downstream side of the mixer, with the external setting agent dispenser being connectable to a supply of setting agent and having a discharge opening at the periphery of the reconstitution passage.

The mixer may be a static mixer, e.g. it may be a mixer as described herein above.

Further, the apparatus may include a tenderiser with its discharge configured to feed a process stream to the inlet of the reconstitution passage and the tenderiser may be a tenderiser as described herein above.

BRIEF DESCRIPTION OF THE DRAWINGS

For a better understanding of the present invention, and to show how the same may be carried into effect, the invention will now be described by way of non-limiting example, with reference to the accompanying drawings in which:

FIG. 4 is a three dimensional view of a mixer element of FIG. 2;

FIGS. 5A, 5B and 5C are three dimensional views of the mixer element of FIG. 4, taken from directions A, B and C, respectively;

FIG. 12 is a three dimensional view of three mixer elements of three separate wall elements of FIG. 6, in their positions relative to one another, in use;

FIG. 13 is a two dimensional diagrammatic representation of material in a process stream past mixer elements of a mixer as shown in FIG. 6;

DETAILED DESCRIPTION OF THE DRAWINGS

Figure 1:
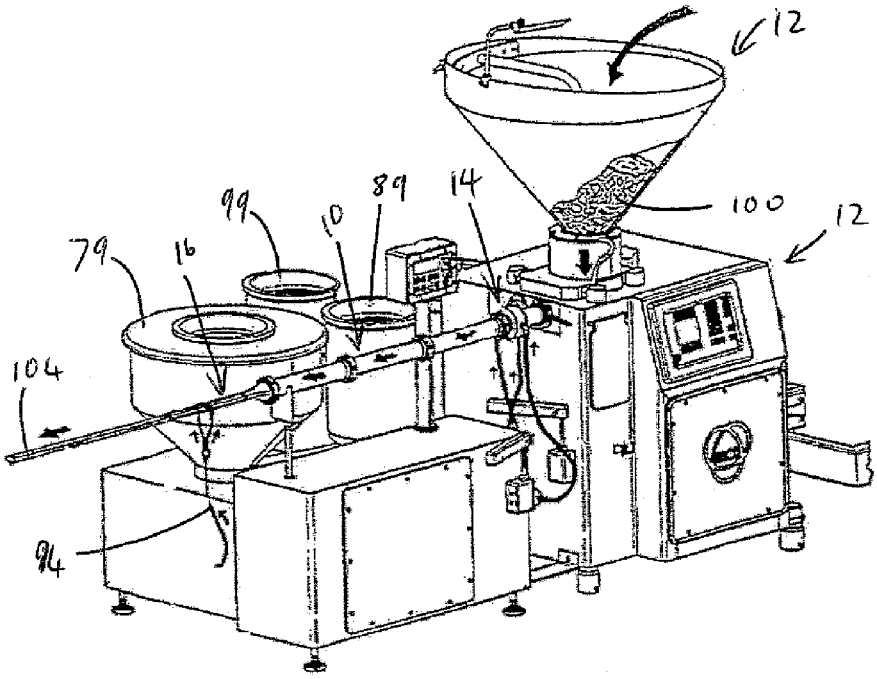
FIG. 1 is a three dimensional view of apparatus for the production of reconstituted food products in accordance with the present invention.

Referring to the drawings, a static mixer in accordance with the present invention is generally indicated by reference numeral 10. Similar features in different embodiments of the invention are identified with the same reference numerals.

Referring to FIG. 1, the mixers 10 of the present invention can be used in a number of different applications, including the manufacture of a reconstituted meat product, but could also be applied advantageously in the processing of fruit, vegetables, poultry, fish, or the like, although it is described in this example with reference only to the processing of meat. An installation for this application could for example include a supply in the form of a filler 12, of a process stream of comminuted meat, means in the form of in-line injectors 14 for injecting additives such as gel and a setting agent into the process stream, the mixer 10 and discharging means 16. The first injector could co-extrude a setting agent into the inside of the process stream while the second injector could co-extrude a gel onto the outside of the process stream of comminuted food particles. (This process is described in more detail below).

The process stream passes though an internal passage of the mixer 10, where it needs to be mixed to homogenise it to distribute the gel and setting agent evenly in the process stream before it sets and possibly to agitate the process stream to prevent premature gel setting, while maintaining the fibrous structure and texture of the meat. The internal passage of the mixer 10 forms part of a reconstitution passage, i.e. the passage along which food travels while being reconstituted in the apparatus illustrated in FIG. 1.

It is to be understood that the static mixer 10 could be used in a wide variety of applications, but in a typical application for food processing, the material to be processed includes comminuted food particles such as particles of meat or cheese, combined with additives such as a gelling agent (e.g. a hydrocolloid such as alginate), a setting agent (e.g. a calcium compound or lactic acid) and/or other additives.

Figure 2:
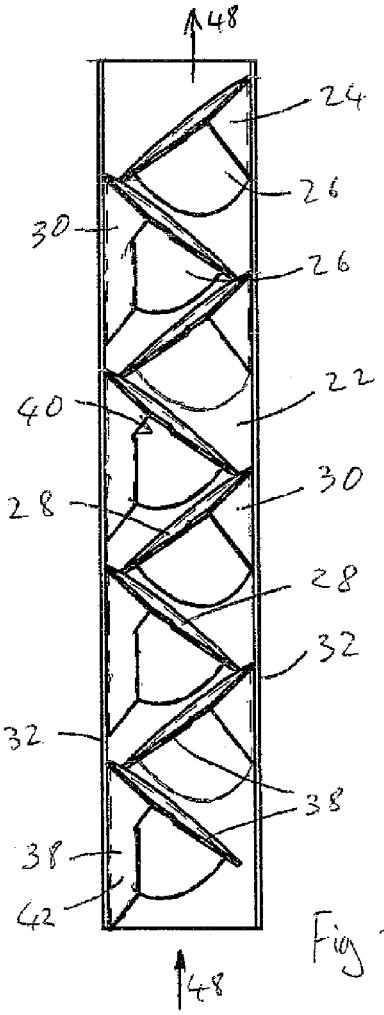
FIG. 2 is an inside view of a wall element and mixer elements of a first embodiment of a mixer in accordance with the present invention.
Figure 3:
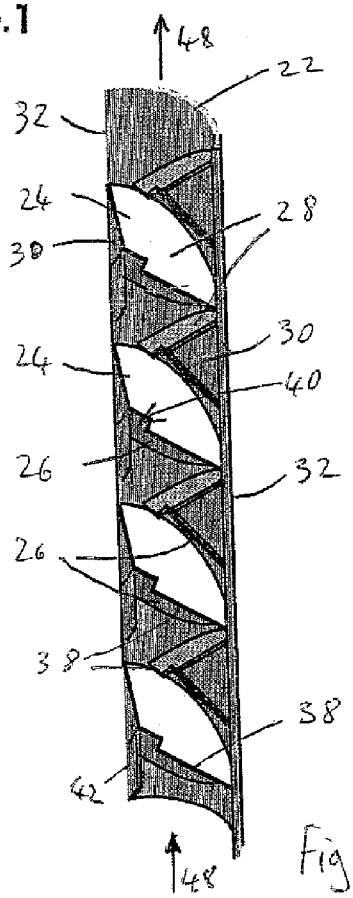
FIG. 3 is a three dimensional view of the wall element and mixer elements of FIG. 2.
Figure 6:
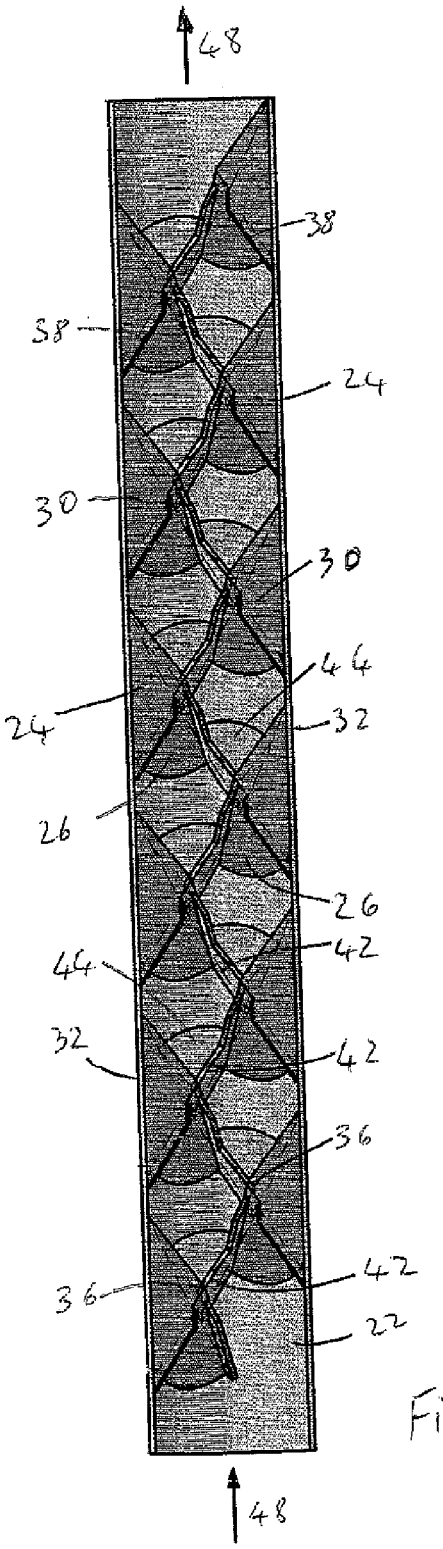
FIG. 6 is an inside view of a wall element and mixer elements of a second embodiment of a mixer in accordance with the present invention.

Referring to FIGS. 2 to 5, a first embodiment of a mixer in accordance with the present invention includes three wall elements 22, each in the form of a longitudinal part of a cylindrical tube, including 120 degrees of the circumference of the tube. It is to be understood that three of the wall elements 22 are placed side-by-side in use, as described in International Application No. WO 2004/008876, to form a cylindrical wall of the mixer 10, defining an internal passage with an inlet and outlet and defining a flow path for the process stream, extending from the inlet, in a downstream direction, to the outlet. The flow direction of the process stream is shown in FIGS. 2 and 3 by arrows 48. The wall elements 22 can be kept in their side-by-side arrangement in a number of ways, but preferably by housing them inside a cylindrical casing.

Each wall element 22 includes a plurality of staggered mixer elements 24 attached to the inside of the wall element to protrude into the internal passage of the mixer 10. By the term "attached", is meant that the mixer elements 24 could be removably attached to the wall elements 22, could be fixedly attached, e.g. by being welded to the wall elements, could be integrally formed with the wall elements, e.g. in a unitary casting, or the like.

Each mixer element 24 is in the form of a triangular pyramid with a leading surface 26 facing in the upstream direction towards the inlet of the mixer 10, a trailing surface 28 facing in the downstream direction towards the outlet of the mixer and a third or lateral surface 30 that is generally aligned with a lateral edge 32 of the wall element 22 and has a radial orientation in the mixer, when assembled.

Each of the surfaces 26,28,30 of the mixer element 24 is generally triangularly shaped with one of its edges forming a root 34, where the surface meets the inside surface of the wall element 22 and an apex 36 at the corner of the surface that is opposite from its root. The leading and trailing surfaces 26,28 are oriented at angles such that they intersect at an angle of about 90 degrees. This angle could be more or could be less, but if it is too large, the mixing effectiveness of the mixer is reduced and if the angle is too small, the mixing element is too narrow and could form pockets on its downstream side where the process stream may stagnate and/or where food may become trapped.

The orientation of the lateral surface 30 extending in a plane that is radial and longitudinal in orientation relative to the cylindrical shape of the mixer, causes the profile of its root 34 to be generally straight, whereas the angled profiles of the leading and trailing surfaces 26,28 causes their respective roots to have convexly curved profiles. The angles at which the leading and trailing surfaces 26,28 meet the inside surfaces of the wall elements 22 at their respective roots, are obtuse.

The geometry of the mixing elements 24 has been described in some detail above, but it is to be understood that different geometrical shapes would also be effective in achieving the purposes of the mixing elements. However, the shape described has been found in practice to be particularly effective in achieving effective mixing, while preventing local stagnation of the process stream, which could cause the time that some portions of the flow stream remain in the mixer, to be too long.

Each mixer element 24 includes two ridges 38 that extend along the two edges of the leading surface 26, where it meets the trailing surface 28 and lateral surface 30. The ridges 38 are generally co-planar extensions of the trailing and lateral surfaces 28,30 and stand proud of the leading surface 26 in a generally upstream direction. Each ridge 38 extends from the root 34 of the leading edge and stops short from its apex 36, so that an apex gap 40 is defined between the ends of the two ridges. The triangular shape of the leading surface 26, with its two ridges 38 extending in a tapering manner along its edges towards the apex gap 40 forms a two dimensional funnel formation on the leading surface.

As can be seen in FIGS. 2 and 3, on one lateral side of the wall element 22, the ridges 38 that extend from the lateral surfaces 30, extend farther from the leading surface than the ridges extending from the trailing surfaces, thus forming ridge extensions 42. On the opposite lateral side of the wall element 22, there are no ridges that extend from the lateral surfaces 30, as shown in FIGS. 4 and 5.

As can be seen in FIGS. 2 and 3, the mixer elements 24 are staggered on the inside of the wall element 22, with the lateral surface 30 of each mixer element aligned with a lateral edge 32 of the wall element. When the mixer 10 is assembled, the wall elements 22 are placed side-by-side such that the mixer elements 24 along a lateral edge 32 are staggered relative to the mixer elements along the adjacent lateral edge of the next wall element. The ridge extensions 42 of the mixer elements 24 on one wall element 22 thus extend alongside the lateral surfaces 30 of the mixer elements on the adjacent wall element and stand proud of the leading surfaces 26 of that wall element. Each ridge extension 42 thus serves as a ridge 38 for the mixing element 24 of which it forms part and for the adjacent mixing element 24 of the next wall element 22. For the sake of clarity, it could be mentioned that the lateral surfaces on both sides of the wall element 22 in FIGS. 2 and 3 have been allocated the same number, even though the shapes of the lateral surfaces differ, in that the lateral surfaces on the left hand side of the wall elements also include ridge extensions.

In the staggered formation of the mixer elements 24, the apex gap 40 of each mixer element is generally upstream of the leading surface 26 of another mixer element, typically a mixer element on the next wall element 22. By "generally upstream" is not meant that the apex gap 40 is directly longitudinally upstream of the next mixer element's leading surface 26, but that material that flows form the apex gap is likely to impinge the leading surface of the next mixer element.

The longitudinal spacing of the mixer elements 24 along the inside of each wall element 22 can be selected to suit the particular application, e.g. a smaller gap can be used in the case of fine comminuted process stream particles and a larger gap can be used for chunkier process stream particles.

In use, when the process stream flows through the mixer 10, it is agitated by the staggered apices 36 of the mixer elements 24 that protrude into the internal passage of the mixer. In addition, the process stream is cleaved and split by the ridges 38 that protrude generally in an upstream direction. As part of the process stream impinges a leading surface 26, its flow direction is changed, so that the particular part of the process stream is "folded" relative to the rest of the process stream. Further, as parts of the process stream impinge the leading surfaces 26, they slide along these surfaces in a downstream direction towards the apex gap 40, while being compressed or funneled by the ridges 38, to be discharged at the apex gap at an elevated pressure. The local increase in pressure causes the material passing through the apex gap 40 to flow at a higher velocity than the rest of the process stream and to have more momentum, driving it in the direction in which it exits the apex gap, generally towards the leading surface of the next mixer element.

The agitation, cleaving and splitting, folding and internal variations on velocity that is imparted on the process stream by the mixer elements causes it to be homogenised sufficiently, while retaining its fibrous structure and texture. In particular, it causes parts of the process stream that are split, folded, accelerated, etc. to be layered relative to one another.

Referring now to FIGS. 6 to 14, in a second embodiment of a mixer 10 in accordance with the present invention, the mixer 10 also includes three wall elements 22, identical to those of the first embodiment and staggered mixer elements 24 attached to the wall elements, each mixer element with a leading surface 26, trailing surface 28 and lateral surface 30 and with ridges 38 and an apex gap 40 between the ends of the ridges, near the apex 36. However, the geometrical shapes of the mixer elements 24 are somewhat different, in that they are narrower, with an orientation that is closer aligned with the longitudinal axis of the mixer.

Further, each of the mixer elements 24 of the second embodiment has a ridge 38 extending from the lateral surface 30, without a ridge extension. Instead, each mixer element 24 has a ridge extension 42 that extends from the ridge 38 that extends from the trailing surface 28 and the ridge extension extends in an angled upstream direction up to the trailing wall of the next upstream mixer element.

In order to prevent flow stagnation behind each ridge extension 42, it is three dimensionally shaped to define a downstream surface 44. Each ridge extension 42 extends from the inside of the wall element 22 by a shorter distance than the apex 36, so that the ridge extension forms less of a flow impediment than the rest of the mixer element 24 and so that a part of the ridge 38 between the ridge extension and the apex gap 40 forms a relatively small protuberance 46, extending in an angled, upstream direction.

In use, the process stream is agitated, cleaved, folded and locally compressed and accelerated in much the same ways as described hereinabove, with reference to FIGS. 2 to 5 to form a layered process stream. However, in the second embodiment of the mixer, as part of the process stream reaches the position upstream of a leading surface 26, it may impinge the leading surface and be funneled by the ridges 38 towards the apex gap 40, or it may instead flow across the smaller ridge extension 42, or ideally part of it may be funneled along the leading surface and part of it may flow over the ridge extension, with the protuberance 46 splitting these parts, possibly by cleaving the process stream. The part of the process stream that flows over the ridge extension 42 immediately reaches the position upstream of the next downstream leading surface 26, where it is combined with material funneled through an apex gap 40 of an adjacent mixer element 24. This configuration thus encourages continual cleaving and splitting of the process stream, funneling and accelerating a split-off part, and recombining the accelerated part with another part of the process stream, thus further enhancing layering and homogenisation.

Figure 10:
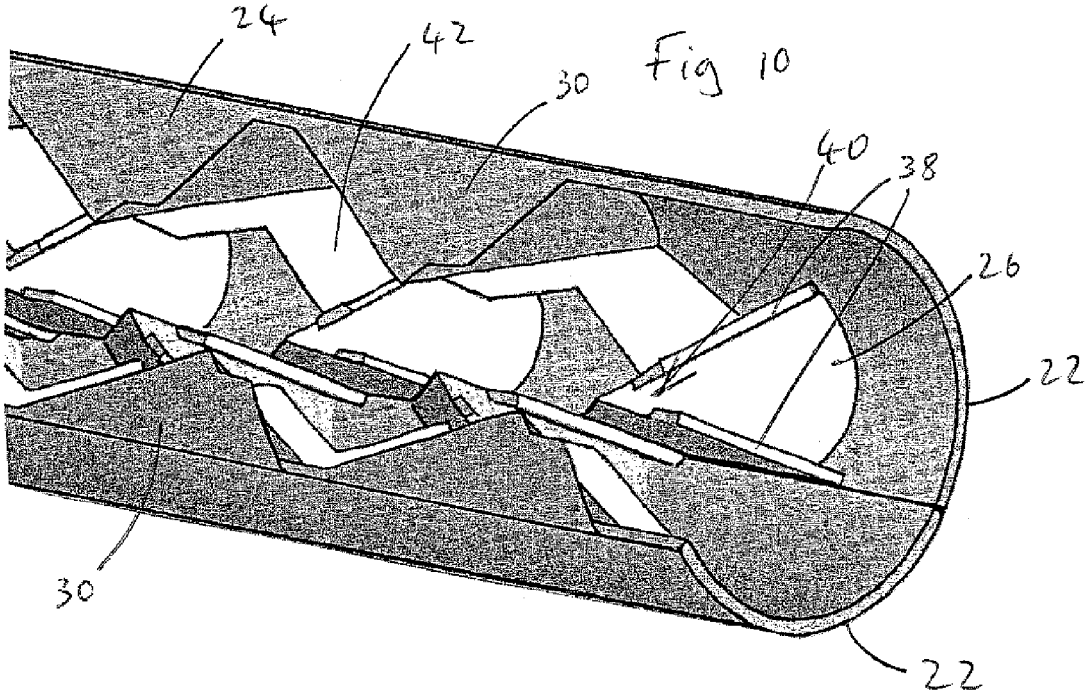
FIG. 10 is a three dimensional view of two wall elements of FIG. 6 with their mixer elements, in a side-by-side arrangement.

Referring to FIG. 10, the lateral surfaces 30 and ridges 38 of mixer elements 24 on adjacent wall elements 22, abut along the lateral edges 32, to form a continuous wall extending in a longitudinal direction along the lateral edges and thus further impedes the flow and prevents the process stream from flowing along a relatively gentle zigzag path between the staggered mixer elements of adjacent wall elements, as occurred in the prior art.

Figure 11:
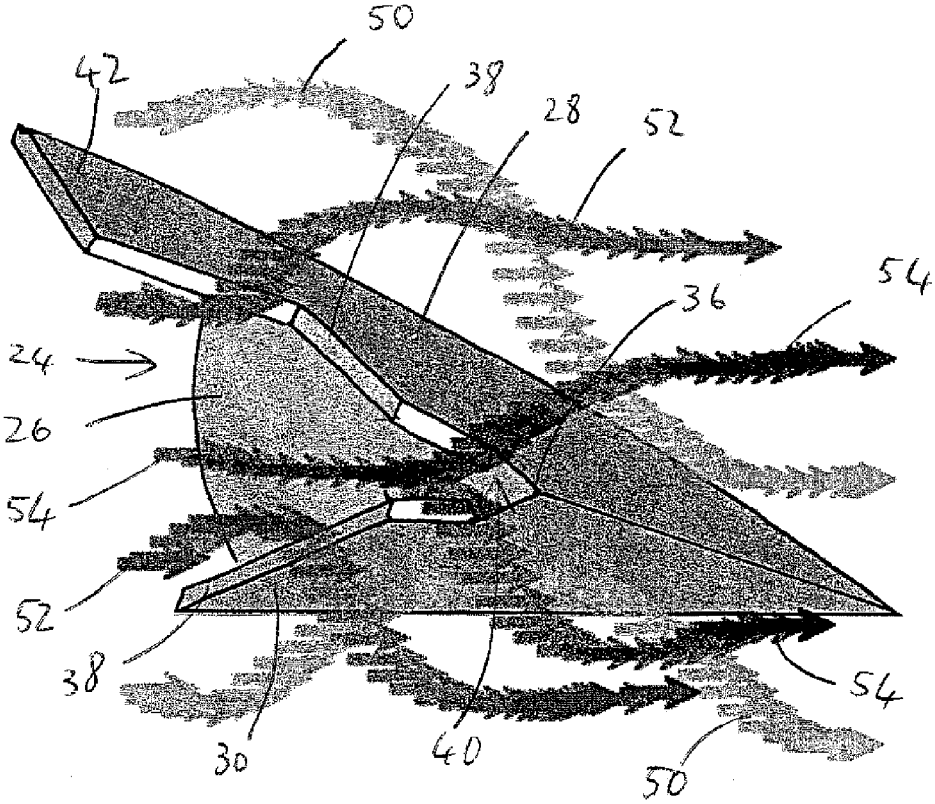
FIG. 11 is a three dimensional view of a mixer element of FIG. 6, with arrows showing flow paths of the process stream.
Figure 14:
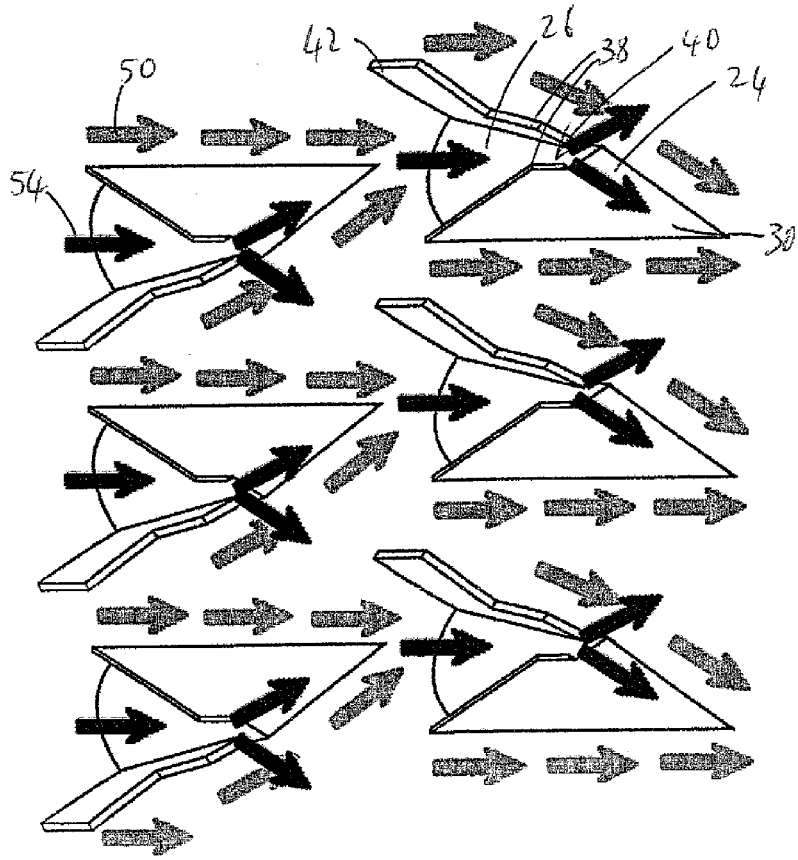
FIG. 14 is a two dimensional diagrammatic representation of mixer elements of all three wall elements of a mixer as illustrated in FIG. 6, in a spaced arrangement.

Referring to FIGS. 11 and 14, some of the flow patterns of the process stream in relation to the mixer elements 24 are shown. As can be seen in FIG. 11, parts of the process stream, indicated by reference numeral 50 flow around the outsides of the mixer element 24, adjacent the trailing surface 28 and lateral surface 30. Other parts of the process stream, designated with reference numeral 52, flow over the ridges 38 and ridge extension 42 and thus flow over the parts 50. Further, other parts of the process stream, designated with reference numeral 54, impinge the leading surface 26, are funneled between the ridges 38 and pass through the apex gap 40, from where it flows over the parts 50 and 52. The combined effect of the changes of direction of parts of the process stream is that they are effectively folded over each other in layers and are intertwined and mixed together thoroughly.

In FIG. 14, the parts 52 have been omitted for the sake of clarity and the reference numerals that relate to each mixer element have only been provided for one such element. The parts 50 of the process stream are shown in lighter arrows, while the parts 54 are shown in darker arrows. This drawing illustrates how the folded, layered and intertwined process stream that results form the actions of one mixer element 24 is again divided into parts that are folded and layered in the next downstream mixer element, together with parts of the process streams of other mixer elements, to enhance the intertwining effect of the mixing action.

Referring to FIG. 12, two effects of the three dimensional arrangement of mixer elements 24 can be seen. The one is that the apices 36 of the three mixer elements 24 are relatively close to one another, thus forming a constricted zone 56 in the passage of the process stream, while the parts of the passage immediately upstream and downstream of the mixer elements are less constricted and form open zones 58. As the process stream thus passes through the passage, it experiences consecutive compression when flowing into a constricted zone 56 and expansion when flowing into an open zone 58. This is also illustrated in FIG. 13, which shows material 60 (e.g. meat pieces or other food pieces) of the process stream that is consecutively compressed and expanded. The compression and expansion assists in causing additives to be distributed more evenly in the material by way of a pumping action within the fibrous structure of the material and enhances the mixing action by opening up comminuted particles that may have become crumpled, without any adverse effect on the fibrous structure of the material 60.

The other effect that can be seen in FIG. 12 is that the longitudinal orientation of each lateral surface 30 and the angled orientation of each trailing surface 28, gives each mixer element 24 a slightly angled orientation. The combined, three dimensional effect of the three mixer elements 24, is that they form a slight spiral that twists the process stream by a small angle, which further enhances the effects of compression and expansion and mixing in general.

Figure 15:
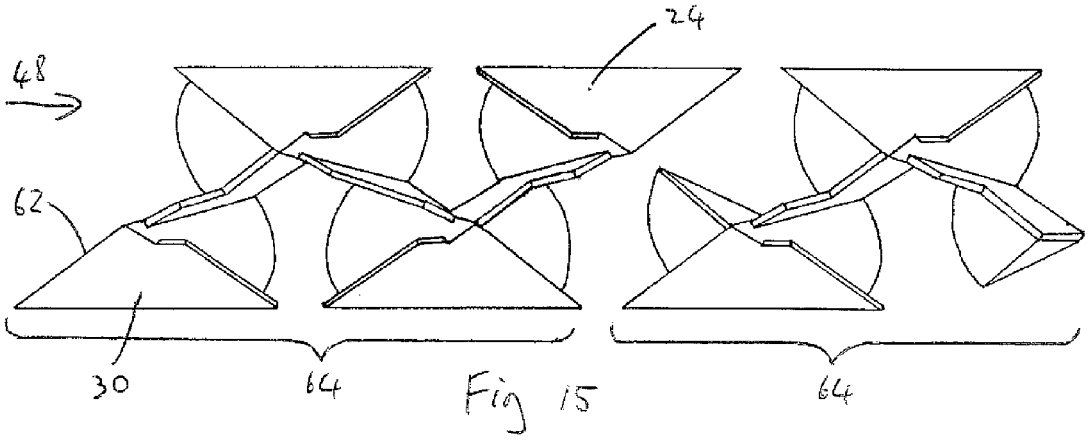
FIG. 15 is a three dimensional view of mixer elements in a third embodiment of a mixer in accordance with the present invention

Referring to FIG. 15, in a third embodiment of a mixer in accordance with the present invention, some of the mixer elements 24 are configured with their leading surfaces 26 and lateral surfaces 30 meeting at acute angles to form sharp leading edges 62 that assist in cleaving and splitting the process stream. In reality, the mixer elements 24 with such leading edges 62 are identical to the mixer elements of the second embodiment, but have been positioned with an opposite orientation in relation to the flow direction 48.

Figure 9:
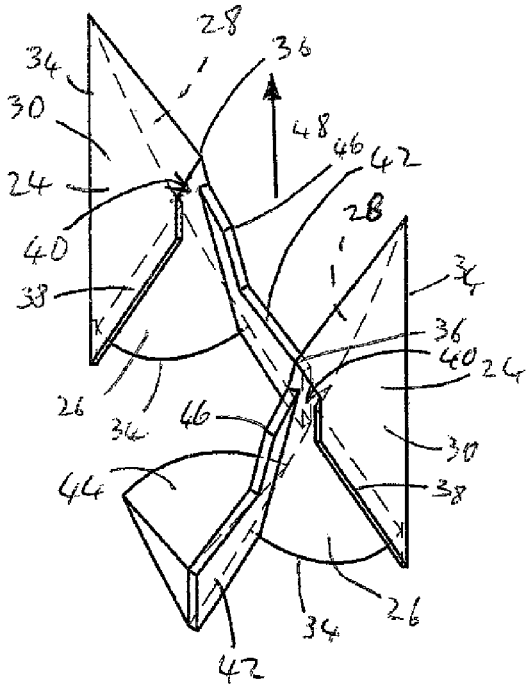
FIG. 9 is a three dimensional view of two adjacent mixer elements of FIG. 6.
Figure 7:
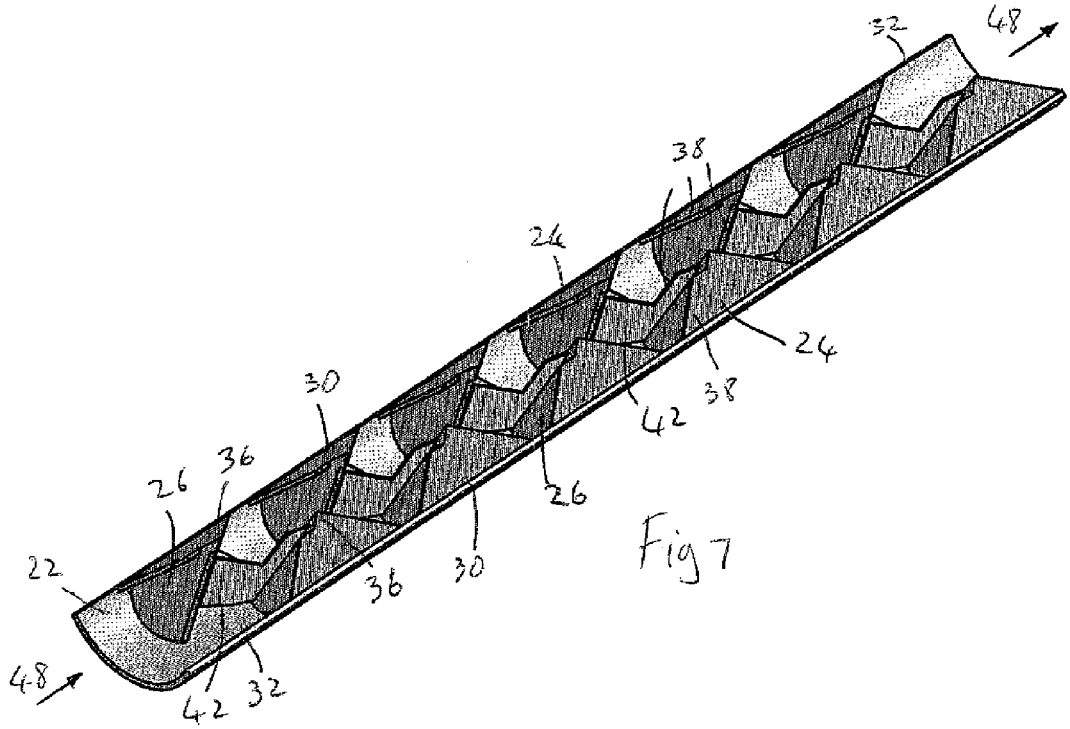
FIGS. 7 and 8 are three dimensional views of the wall element and mixer elements of FIG. 6, from different directions.
Figure 8:
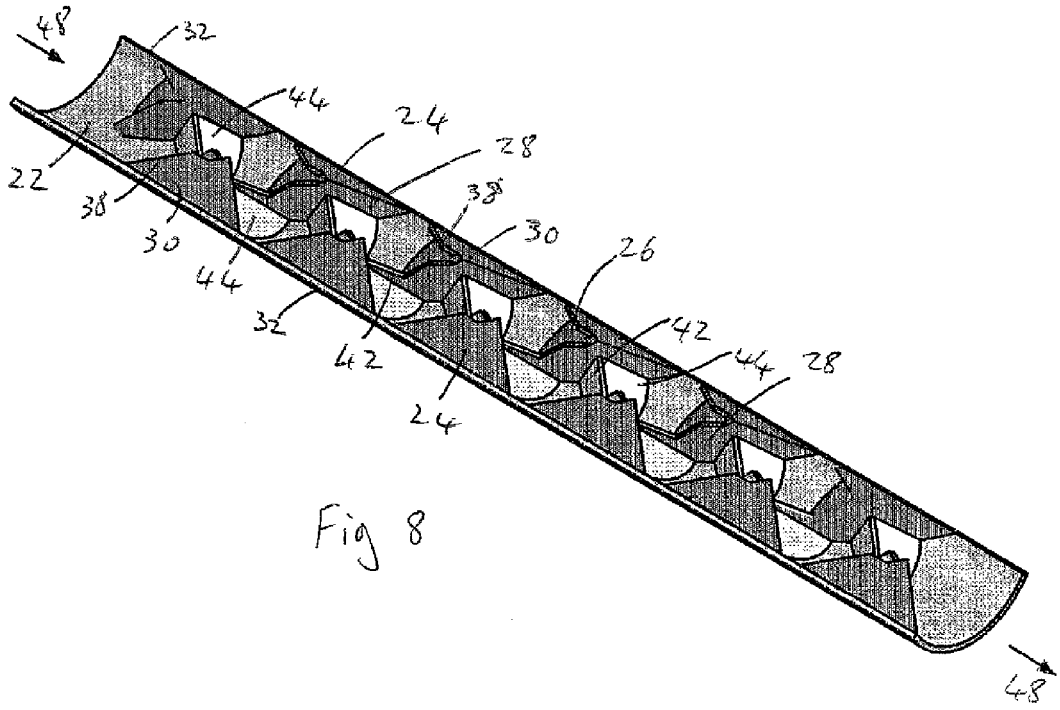

The mixer elements 24 of the third embodiment are grouped together in clusters 64 that are spaced apart and some clusters may have the same orientation as the mixer elements shown in FIG. 9, while others may have the opposite orientation. The orientations of such clusters 64 may also form a pattern, e.g. every third cluster may be inverted, or the clusters with different orientations may have a random distribution.

Referring to FIGS. 1, 16, 17, 19, 20 and 21, reference numeral 100 refers to a food raw material prior to having been homogeneously mixed with a gelling agent and internal setting agent. In the illustrated example, the food raw material comprises off-cuts (i.e. pieces) from meat processing and/or less tender meat pieces, from which excessive tendons, cartilage and bone material have been removed in advance. However, it should be understood that the apparatus and the method according to the present invention is also suited to the reconstitution of lower quality meat parts into pet food, as well as to other types of food products from different food materials, such as fish, cheese, fruit, nuts, vegetables, or a combination thereof. The materials may be raw, blanched, pre-cooked, hot or cold, or a combination of any of these. This list is non-exhaustive.

Figure 16:
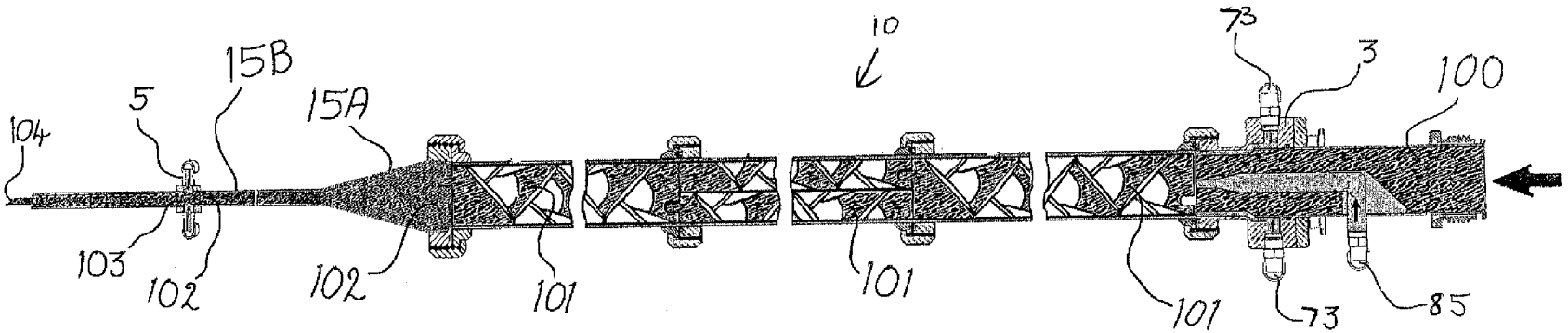
FIG. 16 is a longitudinal section of a reconstitution passage of the apparatus of FIG. 1, in use.
Figure 17:
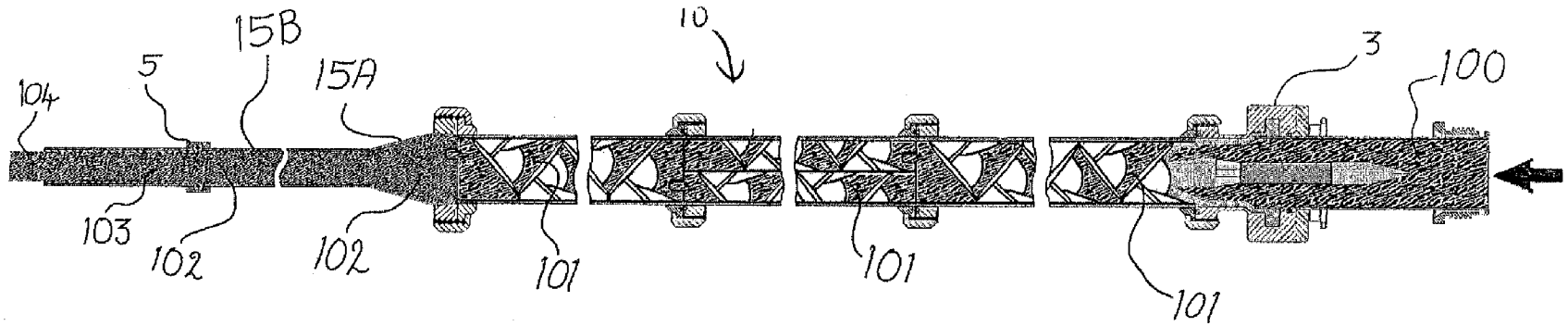
FIG. 17 is a longitudinal section of the reconstitution passage of FIG. 16, seen in plan view.

Referring to the FIGS. 16 and 17, reference numeral 101 refers to the mixture of food raw material, gelling agent, and setting agent as it is being homogeneously mixed in the internal passage of a static mixer section 12 of the reconstitution passage. Referring to the FIGS. 16, 17, 22 and 23, reference numeral 102 refers to this mixture after it has left the static mixer section 10 of the reconstitution passage, prior to the application of an external setting agent. Referring to the FIGS. 16, 17 and 22, reference numeral 103 refers to this mixture after it has received the external setting agent. Referring to FIGS. 1, 16 and 17, reference numeral 104 refers to the product as it exits the shaping section, ready to be portioned. (The reconstitution passage is not identified by a reference numeral in the drawings, but the entire passage filled with the food material 100 and the consecutive the mixtures 101 to 104, comprises the reconstitution passage, to which reference is made in the specification, by reference numeral 1).

Figure 19:
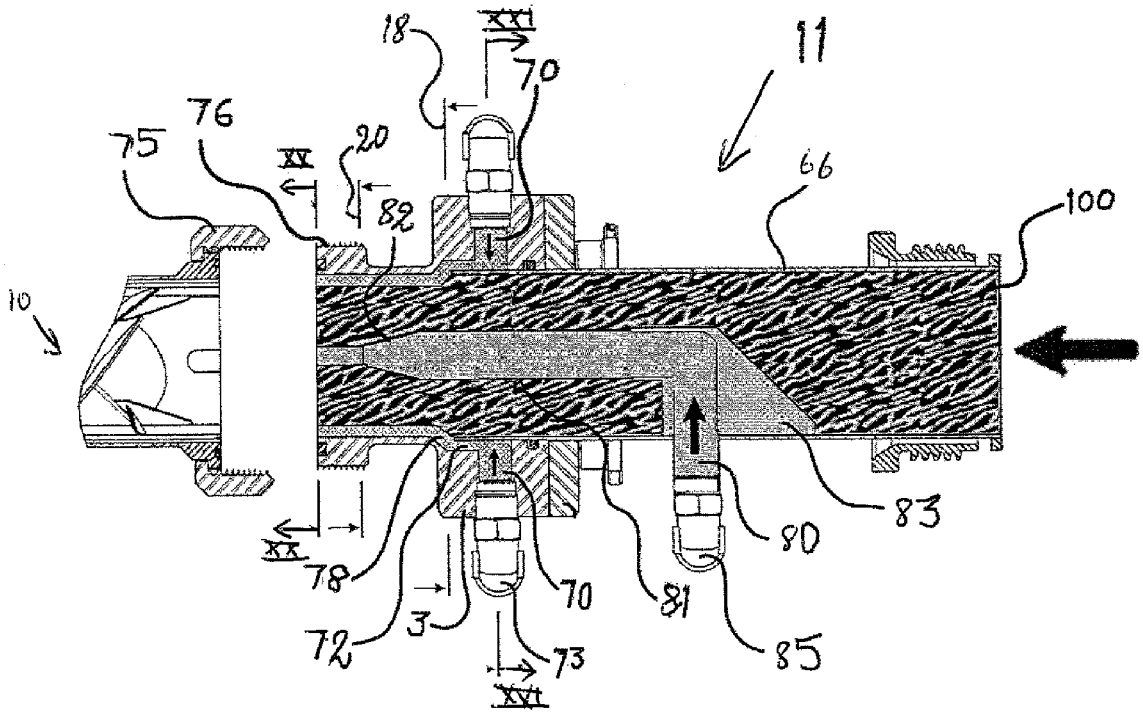
FIG. 19 is a detail sectional view of the co-extrusion section of FIG. 18, with the static mixer (left) separated from the co-extrusion section (right), during the start-up.
Figure 20:
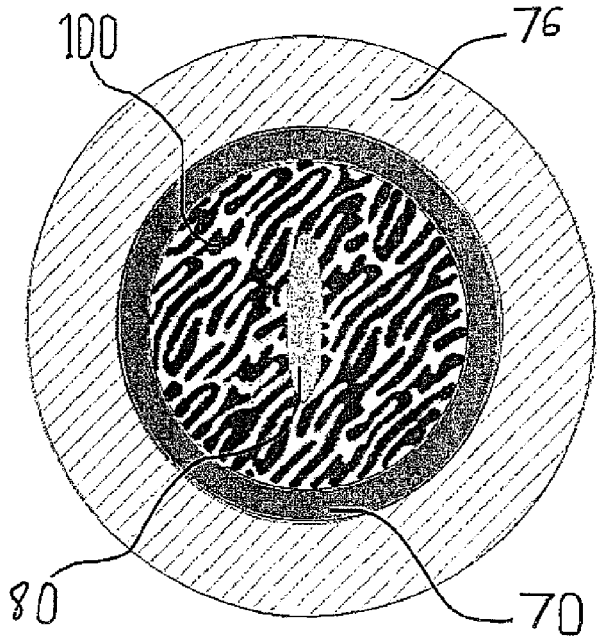
FIG. 20 is a cross-sectional view of the co-extrusion section of FIG. 19, taken at XX-XX.
Figure 21:
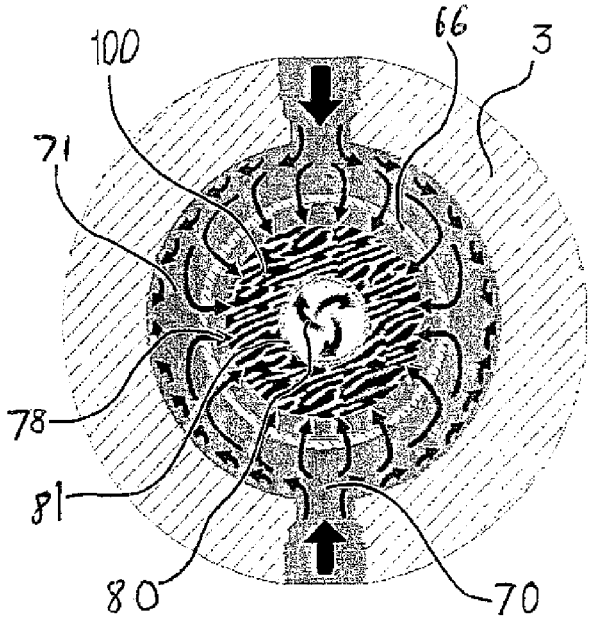
FIG. 21 shows a cross-section of the co-extrusion section of FIG. 19, taken at XXI-XXI.
Figure 23:
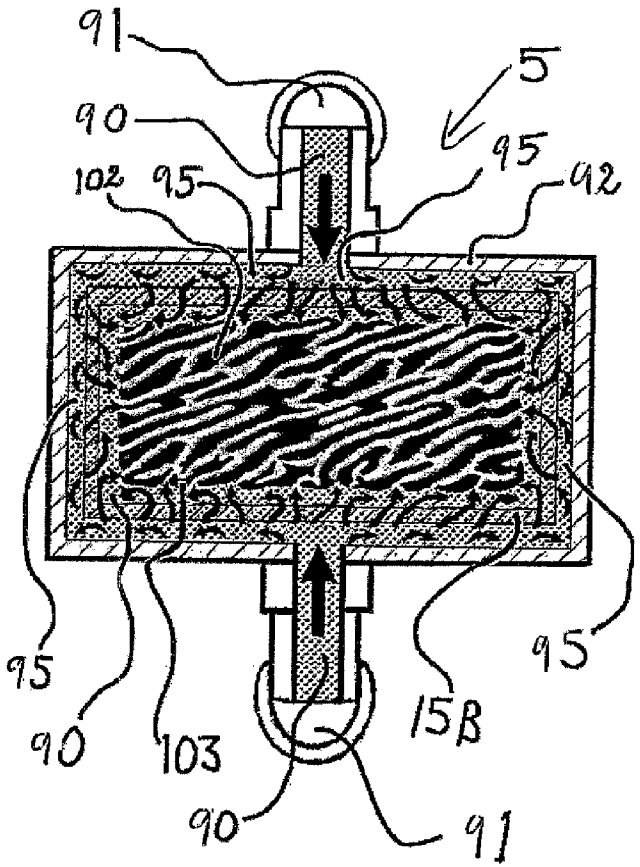
FIG. 23 is a cross-section of the external setting agent dispenser of FIG. 22, taken at XXIII-XXIII.
Figure 22:
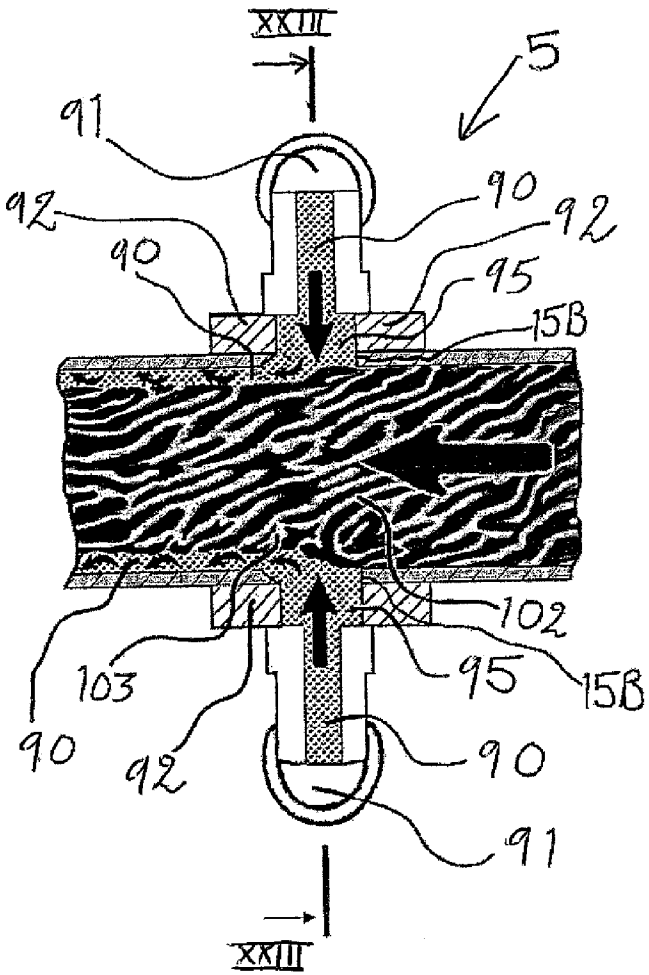
FIG. 22 is a detailed longitudinal section of a means for delivering an external setting agent (i.e. an external setting agent dispenser), downstream of the static mixer.
Figure 25:
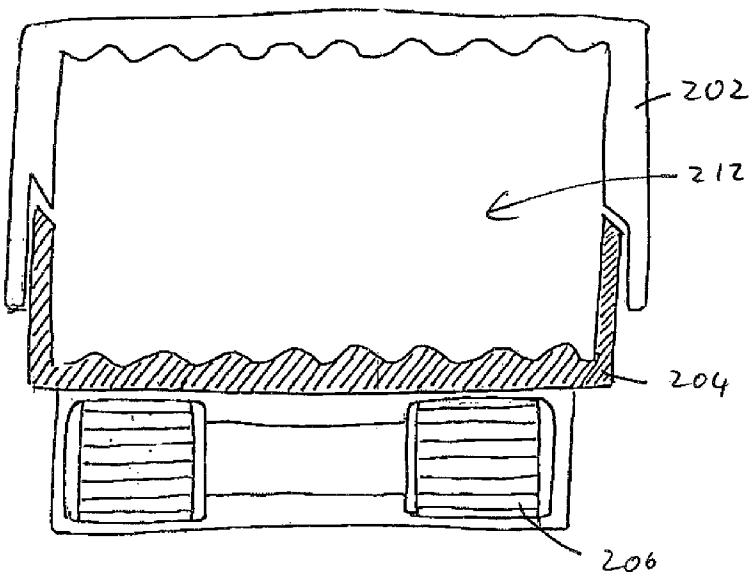
FIG. 25 is a top plan view of the tenderiser of FIG. 24 from which the internal flutings have been omitted.
Figure 26:
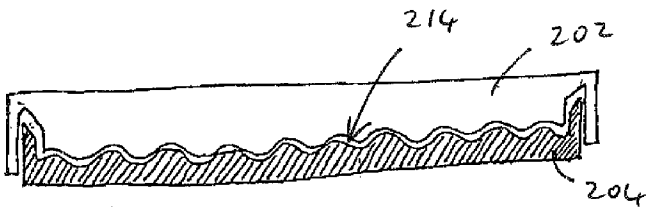
FIG. 26 is a bottom view of the tenderiser of FIG. 24.
Figure 24:
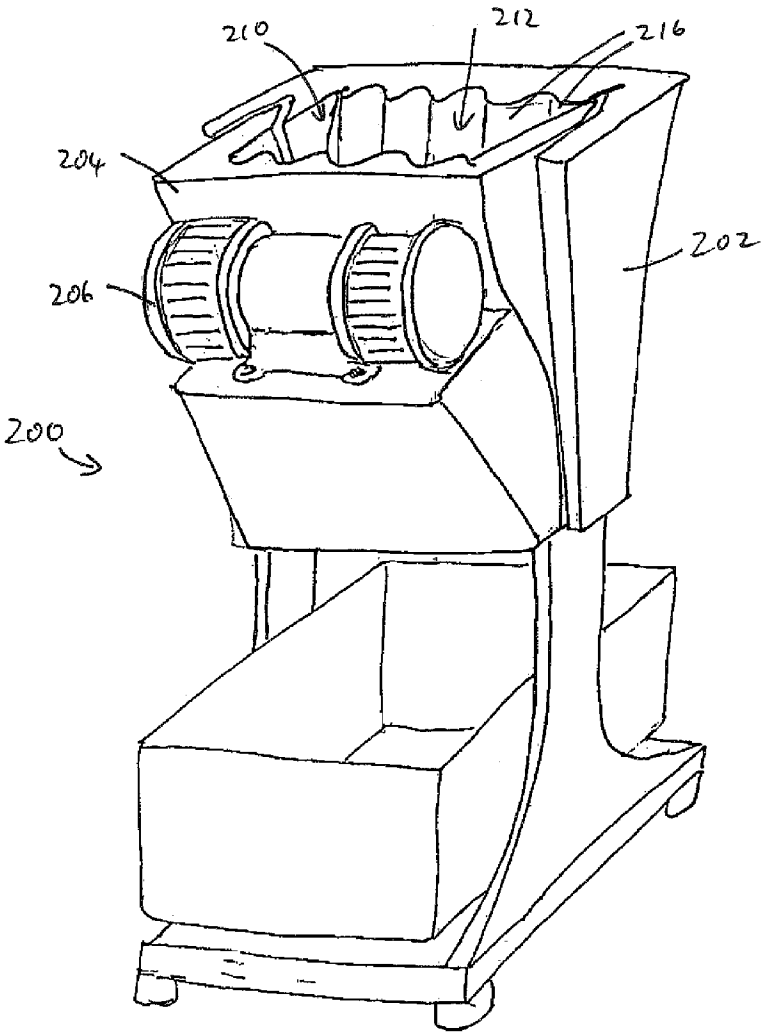
FIG. 24 is a three dimensional view of a tenderiser in accordance with the present invention.

Referring to FIGS. 19 to 21, reference numeral 70 refers to the gelling agent. In a preferred embodiment of the invention, such gelling agent would contain a hydrocolloid, such as sodium alginate, as the primary reagent; however, the gelling agent may, alternatively, contain a different primary reagent. Reference numeral 80 refers to the internal setting agent. In a preferred embodiment of the invention, it contains a calcium compound as the primary reagent; however, the internal setting agent may, alternatively, contain a different primary reagent, such as an organic acid. Referring to FIGS. 22 and 23, Reference numeral 90 refers to the external setting agent. In a preferred embodiment of the invention, like the internal setting agent 80, it contains a calcium compound as the primary reagent; however, the external setting agent may, alternatively, contain a different primary reagent, such as an organic acid.

The gelling agent 70 and the internal setting agent 80 are preferably supplied in the form of gel or as a powder for making a gel, while the external setting agent 90 is preferably supplied as a liquid or a powder for preparing a liquid. The gel and liquid forms respectively make it easier for these additives to be applied. Other compositions may be used for the gelling and internal and external setting agents, the determination of their composition being within reach of a person skilled in the use of hydrocolloids for the reconstitution of foods.

Referring to FIG. 1:

79 is a tank from which the gelling agent 70 is dispensed;

89 is a tank from which the internal setting agent 80 is dispensed; and

99 is a tank from which the external setting agent 90 is dispensed.

The steps involved in manufacturing a reconstituted food product according to the embodiment illustrated in FIGS. 1 and 16 to 23 will now (including the start-up procedure) will now be described broadly with reference to the drawings.

Referring to FIG. 1, the food raw material 100 is placed into a collection vessel of the filler 12 from which it will is pumped into the reconstitution passage. The food raw material 100 is preferably pre-treated by tenderising as described in more detail below.

Figure 18:
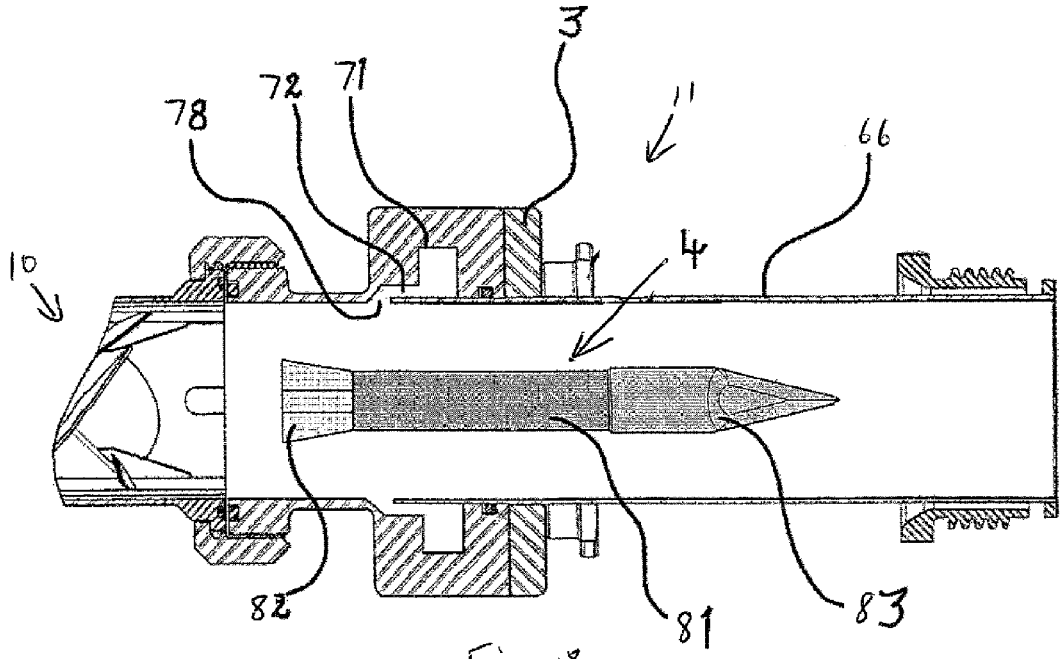
FIG. 18 is a detail sectional plan view of a co-extrusion section of the reconstitution passage of FIG. 16.

Referring to FIGS. 1, 18 and 19, the gelling agent 70 is poured into the tank 79 and gently pumped, and then stopped, so that the inlet nozzles 73 are filled with gelling agent prior to the commencement of production. The internal setting agent 80 is poured into the tank 89 and is gently pumped and then stopped, so that the injection means 4 is filled with the internal setting agent 80 prior to the commencement of production. The external setting agent 90 is poured into the tank 99 and is gently pumped and then stopped, so that the delivery pipe 94 is filled with the external setting agent 90 prior to the commencement of production. Each of these tanks 79, 89 and 99 is fitted with pumping means to deliver the respective reagents to the reconstitution passage at the relevant stations.

Referring to FIGS. 1, 16 and 19:

The pumping means of the filler 12 is switched on while the static mixer 10 is still separated from the co-extrusion section 11 of the reconstitution passage 1. When the food raw material 100 has reached the station marked 18 in the co-extrusion section, the mechanism for pumping the gelling agent 70 is switched on. This pumps the gelling agent into the co-extrusion section of the reconstitution passage so as to cover the circumference of the food raw material 100 along the inner walls of the passage. The mechanism for pumping the internal setting agent 80 is then switched on. This supplies the setting agent to the centre of the food raw material 100 in the co-extrusion section of the reconstitution passage at the station marked 20. All three ingredients (the food raw material 100, the gelling agent 70 and the internal setting agent 80) are then simultaneously gently pumped until they reach the downstream end of the co-extrusion section at XX-XX, as illustrated in FIG. 20. The static mixer 10 is then attached to the co-extrusion section 11, and the pumping is continued until the mixture 101 reaches the discharge end of the mixer, whereupon the shaping section 15 is attached to the static mixer 10 as shown. The pumps are then all switched to run at the desired full speed and from then on the process runs in such a way that there is a continuous flow of material through the reconstitution passage 1.

As the dosed food raw material 100 (FIG. 19) moves forward towards the static mixer section of the reconstitution passage, no setting can begin, since the gelling agent 70 on the outside of the food raw material has not yet come into contact with the setting agent 80 on the inside. Once the dosed raw material enters the static mixer section 10, it flows through the mixer as described hereinabove with reference to FIGS. 2 to 15.

Thereafter, with the setting process having commenced as soon as the gelling and setting agents were brought into contact with one another, the homogeneous mixture 102 now enters the shaping section of the reconstitution passage, where it is forced through a cylinder which imparts the desired shape. The cylinder illustrated in FIGS. 22 and 23, for example, would form the product into a continuous rectangular block.

According to the illustrated embodiment of the invention, the mixture 102 is then coated with an external setting agent 90 (FIGS. 22 and 23), which is continuously delivered into the reconstitution passage immediately prior to the exit point of the shaping section 15. This extrusion 103 (FIGS. 16 and 17) then passes to the end of the shaping section 15. Upon emergence from the shaping section, the set product 104 may be portioned by an automatic portioning device (not shown in the drawings) and packed. The processes and mechanisms involved in manufacturing a reconstituted food product according to this preferred embodiment of the invention will now be described in greater detail.

The food raw material 100 is continuously pumped into the co-extrusion section 11 of the reconstitution passage 1 while the gelling agent 70 and the internal setting agent 80 are simultaneously supplied to this section 11.

Referring to FIG. 19, the apparatus according to the present invention comprises a gelling agent dispenser, i.e. means 3 for delivering the gelling agent 70, such means being arranged peripherally to the co-extrusion section 11, so as to allow the gelling agent 70 to be deposited around the periphery of the food raw material 100; and an internal setting agent dispenser, i.e. means 4 (consisting of sub-sections 81, 82 and 83) for injecting the internal setting agent 80 into the centre of the food raw material 100 within the co-extrusion section 11. The means 4 for delivering the internal setting agent is slightly downstream from the means 3 for delivering the gelling agent. This is done so that there is a lower probability of the two agents being brought into contact with one another during production set-up. Thus, the gelling agent 70 is deposited externally to the flow of food raw material 100, so as to evenly coat this material, whilst the internal setting agent 80 is simultaneously evenly injected into the central region of the flow of food raw material.

The delivery means 3, as illustrated in FIG. 19 in which it is depicted in detail, comprises an inlet chamber 71 (FIGS. 18 and 21) facing onto the cylinder 66. In the illustrated embodiment, in which the extruding section has a cylindrical shape, the inlet chamber 71 appears as a ring around the external perimeter of this cylinder 66 (FIG. 21). The inlet chamber 71 (FIG. 18) is not directly in contact with the food raw material 100, but has a striction zone 72 through which the gelling agent 70 is pumped into the inside of the co-extrusion section of the reconstitution passage via a small annular aperture 78. The inlet chamber 71 is, in fact, an intermediate tank of annular shape (FIGS. 18 and 21), which effectively meters and releases the gelling agent 70 via the striction zone 78 in such a manner that the gelling agent entirely envelops the food raw material 100 as the gelling agent passes through the aperture 78 into this section of the reconstitution passage. In FIG. 21, arrows show the flow of the gelling agent 70 through this aperture 78 over the end of the cylinder 66 into the advancing food raw material 100. (The arrows at the centre show the flow of setting agent 80 inside its duct 81). Thus a thin layer of gelling agent 70 is deposited around the food raw material 100. In other words, the gelling agent is co-extruded with the food raw material. The gelling agent 70 is supplied to the inlet chamber 71 by means of a delivery pipe, engaging in connector fittings 73 on the delivery means 3.

Referring to FIGS. 18 and 19, in the illustrated embodiment, the means 4 for injecting the internal setting agent 80 consists of an inlet duct 81 which runs longitudinally inside the co-extrusion section 11, and culminates in a shaped nozzle 82. The duct 81 is held in position onto the inside of the cylinder 66 by a suitable support 83. There is a duct through the inside of the support, so that the setting agent 80 can be fed through from the tank 89 via the pipe through the connector fitting 85 into the injection duct 81. (The duct 81 is screwed into the support 83, locking the two together, and the nozzle 82 is screwed onto the duct 81. Alternatively, the duct 81 and nozzle 82 could be a single component).

As the food raw material 100 passes through the extruding section 11 (FIG. 19), it impinges on the duct 81. Thus, at the outlet 82, the internal setting agent 80 will be fed into the stream of the food raw material 100. The aperture of the nozzle 82 is preferably elliptical rather than circular, imparting an elliptical stream of setting agent 80 as shown in cross-section in FIG. 20. This ensures maximum exposure of the surface of the food raw material 100 to the setting agent 80, and thus assists in the distribution of the setting agent. The limiting of the size of this aperture also helps prevent the food raw material from entering the nozzle 82 during co-extrusion.

According to a preferred embodiment, the support 83 has a shark-fin shape, so as to offer less resistance to the flow of the food raw material. This shark-fin shape, together with the duct 81, allows for the injection of the setting agent once the food raw material has formed again, the latter having to go over the support and close again in the form of an extrusion. The length of the duct 81 is important to preventing turbulence below the support which would be detrimental to the even depositing of the setting agent within the stream.

Following the depositing of the gelling agent 70 and the injection of the setting agent 80, the three co-extruded ingredients (gelling agent, setting agent and food raw material) move forward, correctly and consistently dosed but not yet blended; i.e., although the food raw material is surrounded by the co-extruded gelling agent, and itself surrounds the co-extruded internal setting agent, there is no contact between the gelling agent and the setting agent yet. This is seen in FIG. 20.

The co-extruded materials then enter the static mixing section 10 (FIGS. 18 and 19) and passing through a succession of static mixers, they are homogeneously mixed, exiting as a mixture 102 at the end of the static mixing section, ready to be shaped. The number of mixers is not limited, and the mixing section 10 may optionally be shortened or lengthened by taking away or adding further such mixers in series, depending on the nature of the material and the desired mixing effect. A mixer 10 may have means for connecting to further respective mixers, thereby making the entire static mixing section extensible to achieve an increased mixing effect. Details such as the chosen shape and configuration of the mixer elements, the length of each successive static mixer 10 and the diameter of each such mixer may depend on the nature of the materials being mixed and the desired mixing action. Equally, a hybridized assortment of mixers may be assembled in series.

Referring to FIG. 19, the external connection between each mixer and the next may, for example, consist of a threaded flange and a connecting ring nut, as may be used for the connection between the first static mixer and the preceding co-extrusion section, where a threaded nut 75 connects to the threaded flange 76 on the co-extrusion section 11.

Referring to FIGS. 16 and 17, the mixing section 10 feeds into a shaping section 15 by means of a frustum-shaped funnel 15A. The transverse shape of the remainder 15B of the shaping section imparts its shape to the extrusion 102 which passes through it. In FIGS. 16, 17, and 23 it can be seen that the product in this example would be shaped into a continuous rectangular shape.

Approximately halfway to one-third of the way down the shaping passage 15B, there is an external setting agent dispenser or applicator 5 for depositing the external setting agent 90. This applicator feeds the setting agent from the tank 99 via a pipe into the shaping passage 15B around the periphery of the extruded mass 102 (FIGS. 22 and 23), in order to externally set the shape imparted to the extruded mass. This means of delivery is similar to the manner in which the gelling agent is applied earlier in the process, except that in a preferred embodiment there is no striction zone in the means 5; in other words, the external setting agent 90 is fed directly from its annular tank 95 onto the mixed material 102 to form a coated material 103.

Referring to FIGS. 22 and 23, the delivery of the setting agent 90 occurs via connector fittings 91 arranged along the periphery of the shaping passage 15B, such fittings supplying the external setting agent 90 to a groove along the inner circumference of the passage. The external setting agent 90 within the annular tank 95 is thus in full contact with the external surface of the mixed mass 102 as it passes through this zone in the shaping passage. In particular, with reference to FIG. 22, the groove could be defined by means of two distinct sections, connected by a suitable plate 92, maintaining the sections slightly spaced. The connector fittings 91 are thus connected to this plate 92. Then, at the outlet of the shaping section 15, the reconstituted product 104 may be sent to a portioning device, not shown in the drawings, to be subdivided into individual portions.

The present invention has hitherto been described with reference to one of the preferred embodiments thereof, but other embodiments include:

An embodiment of the invention in which the gelling agent is mixed with the food raw material prior to co-extrusion;

An embodiment of the invention in which the a water binder such as Xanthan Gum or Carrageenan, is mixed into the food raw material prior to being co-extruded and a gelling agent is imparted as a coating during processing (this is advised, for example, when processing defrosted frozen meat, to stabilize the liquid in the raw material to prevent it from being leeched out and extracted along with the air if a vacuum-filler is used, and also to prevent blood from collecting at the bottom of the hopper if it stands for a while, since that would cause the first products to be produced to be more watery than the rest) The need for addition of the water binder in these circumstances has been described above and is described below with reference to a tenderiser in accordance with the present invention for pre-treating the food raw material 100;

An embodiment of the invention in which the setting agent is mixed in before co-extrusion;

An embodiment of the invention in which the setting agent is co-extruded on the outside, while the gelling agent is co-extruded into the inside;

An embodiment of the invention in which an optional setting agent is added prior to co-extrusion, and the gelling agent is co-extruded both internally and externally (an example of this embodiment is in the reconstitution of cheese, which by virtue of its calcium content may not require a separately added setting agent; or, if a setting agent is used, it may be added when the cheese is chopped prior to being placed into the hopper);

An embodiment of the invention in which the reconstitution passage does not contain a shaping section; instead, the mixed mass is passed to another type of shaping device, such as a moulding mechanism; or it is passed through rollers which turn it into a thin sheet; or into a multi-headed extrusion nozzle for producing smaller shapes in large volume.

It is understood that suitable buffering agents may be included in the formulations for products made according to all of the embodiments of the invention above.

If desired, the setting of the food mixture 103 or any other mixture including a setting agent 80,90, can be expedited by exposing the mixture to ultrasound, e.g. by way of one or more ultrasonic transducers, fitted to the reconstitution passage, downstream of the injection of the setting agent.

Figure 28:
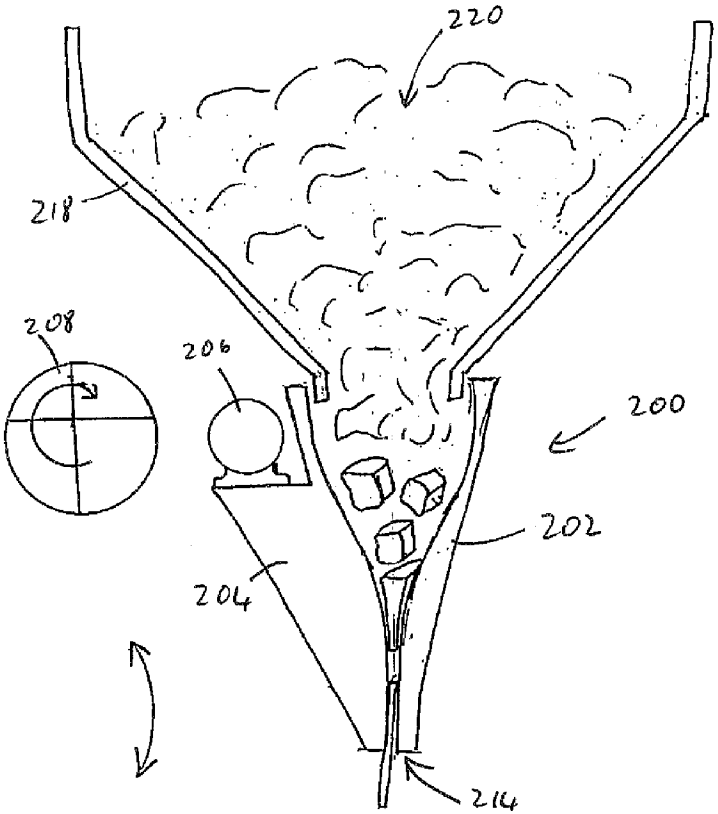
FIG. 28 is a sectional view of the tenderiser of FIG. 24, in use with a feed hopper.
Figure 27:
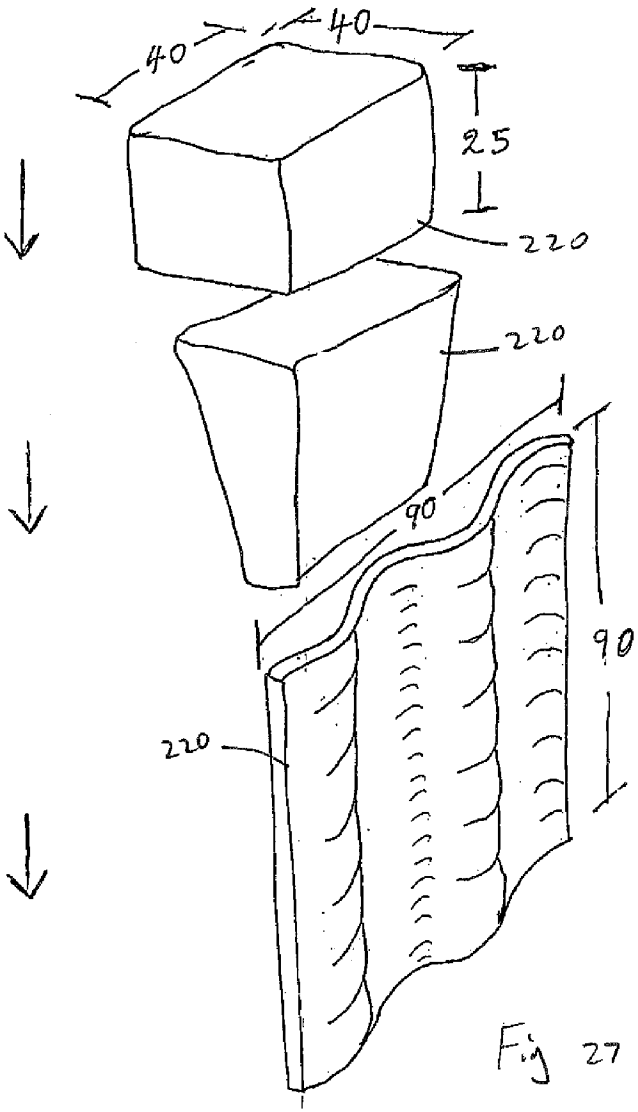
FIG. 27 shows the progress of a food piece while being processed in the tenderiser of FIG. 24.

Referring now to FIGS. 24 to 28, a tenderiser 200 in accordance with the present invention includes a first body in the form of a stationary plate 202 and a second body in the form of a moving plate 204, with an electric vibrator 206 that causes the moving plate to vibrate with small, generally elliptical motions, although the geometry can have other geometrical paths. Other driving means for vibrators, such as hydraulic or pneumatic vibrators may instead by used. The vibrations are caused by rotation of an eccentric mass and a typical motion path of the part of the moving plate 204 where the vibrator 206 is mounted is shown in the detail of FIG. 28. In other embodiments, both plates may have vibrators, but this is not essential.

Each of the stationary and moving plates 202,204 defines a tenderising surface that faces inwardly, towards a tenderising cavity 212 between the plates. At the top of the plates 202, 204, upper regions of their tenderising surfaces are spaced far apart to form a wide inlet 210 to the tenderising cavity 212 and at the bottoms of the plates, lower regions of their surfaces are closer together, defining a narrow gap or outlet (discharge) 214 of the cavity.

Each of the tenderising surfaces has longitudinal flutes 216, complemental to the flutes on the other plate's surface and the crests of the flutes are shaped to define hook formations (shown only in FIG. 31, although preferably present in all the embodiments of the tenderiser 200) pointing downwardly.

In use, food pieces such as meat chunks 220 with exemplary dimensions of 40×40×25 mm are gravity fed via a feed hopper 218 through the inlet 210 into the cavity 212. Inside the cavity, the vibration of the moving plate 204, together with gravity, causes each of the chunks 220 to move towards the outlet 214 and while this happens, the chunk becomes thinner and forms a sheet, as a result of the narrowing width of the cavity, closer to its outlet. The profile of the flutes 216 assists in this process, as it causes the length of the outlet to be even longer and ideally, a chunk with the exemplary dimensions is formed into a sheet of about 90×90 mm, with the grain of the meat still generally intact. The sheet also has a rippled appearance as a result of the undulating profile of the outlet 214, as a result of the flutes 216.

The primary purpose of the vibration of the moving plate 204 is to encourage downward progression of the meat chunks in the cavity 212 and not to compress the chunks by the vibratory movement, although there may also be a smaller element of vibratory compression of the chunks. The progression of the chunks in the cavity 212 is caused by the circular movement of the moving plate 204, as well as a resultant upward and downward rubbing motion closer to the outlet 214, as shown in FIG. 28.

Figure 29:
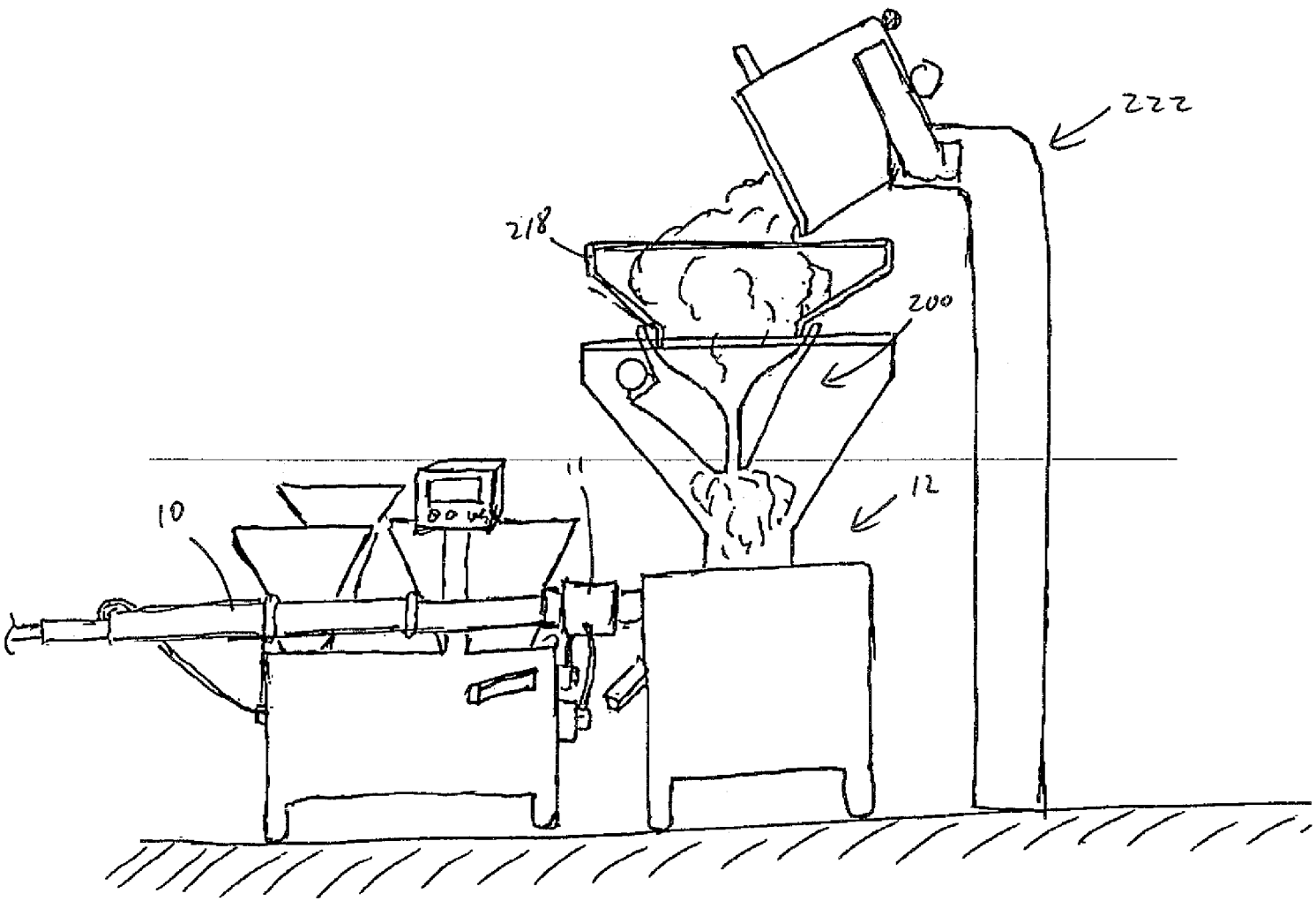
FIG. 29 shows the tenderiser and hopper of FIG. 28 in use with apparatus as illustrated in FIG. 1.

Referring to FIG. 29, the tenderiser 200 and hopper 218 are shown in use with apparatus for producing a reconstituted food product as shown in FIG. 1, including a co-extrusion section 11, a static mixer 10, etc. FIG. 29 shows a conventional trolley hoist 222 for supplying meat to the hopper 218 and the tenderised meat that is dispensed from the outlet 214, falls under gravity into the feed hopper of the filler 12.

Figure 30:
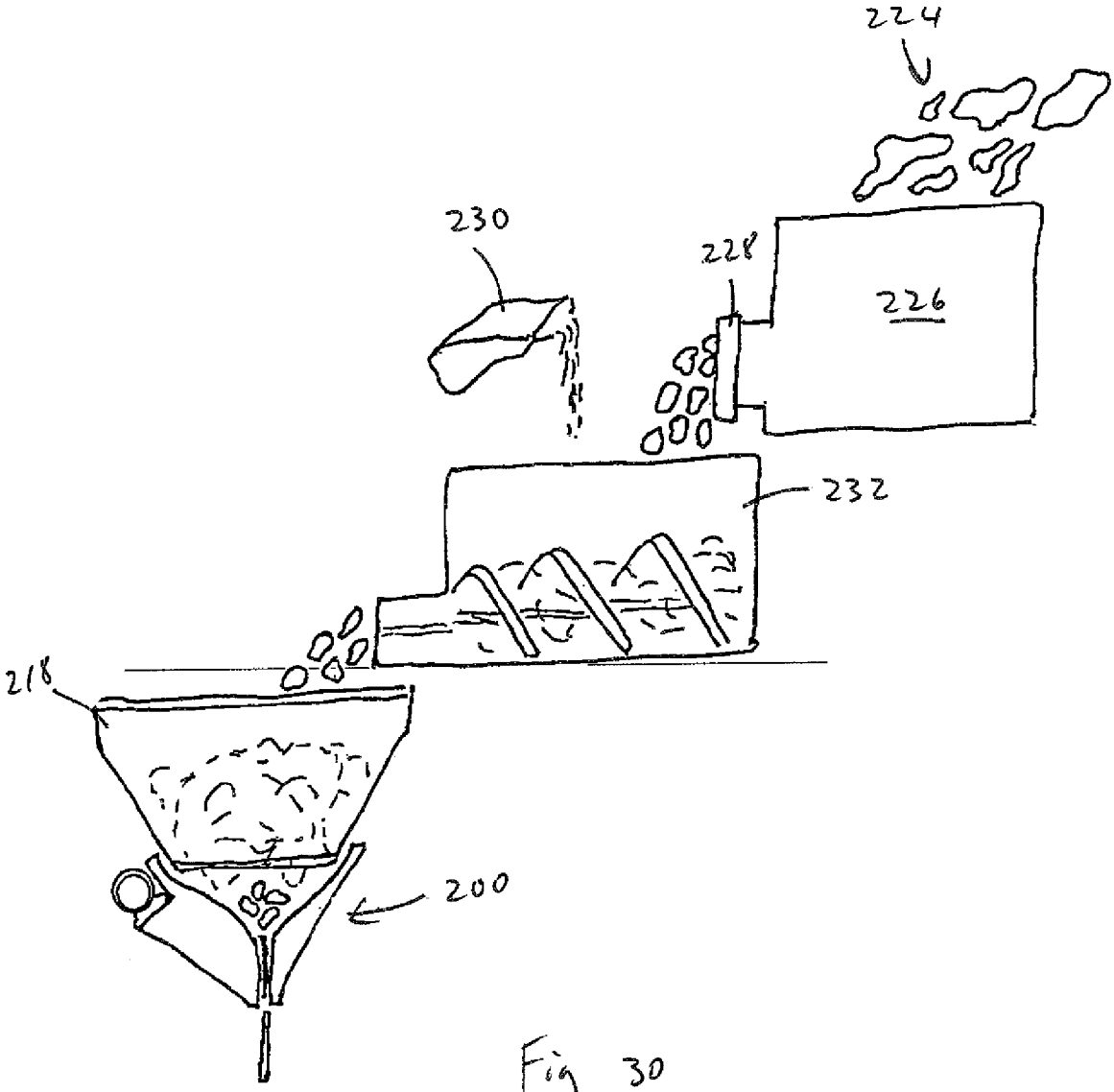
FIG. 30 shows a process to be followed in pre-treating frozen meat and processing it in the tenderiser of FIG. 24.

Referring to FIG. 30, meat 224 that has been pre-frozen is first broken into smaller pieces, e.g. in a cuber or in a mincer 226 with a large kidney plate 228. A water binder such as Xanthan Gum or Carrageenan 230 is added to bind moisture and to lubricate the meat and a mixer of standard industry type is used to mix and move the mass to the tenderiser 200. In this regard, it must be mentioned that unlike in the case of roller or gear-type tenderisers, the water binder will not cause the meat to stick to the compressing plates 202,204 and no scrapers are required to remove meat from the plates.

Figure 31:
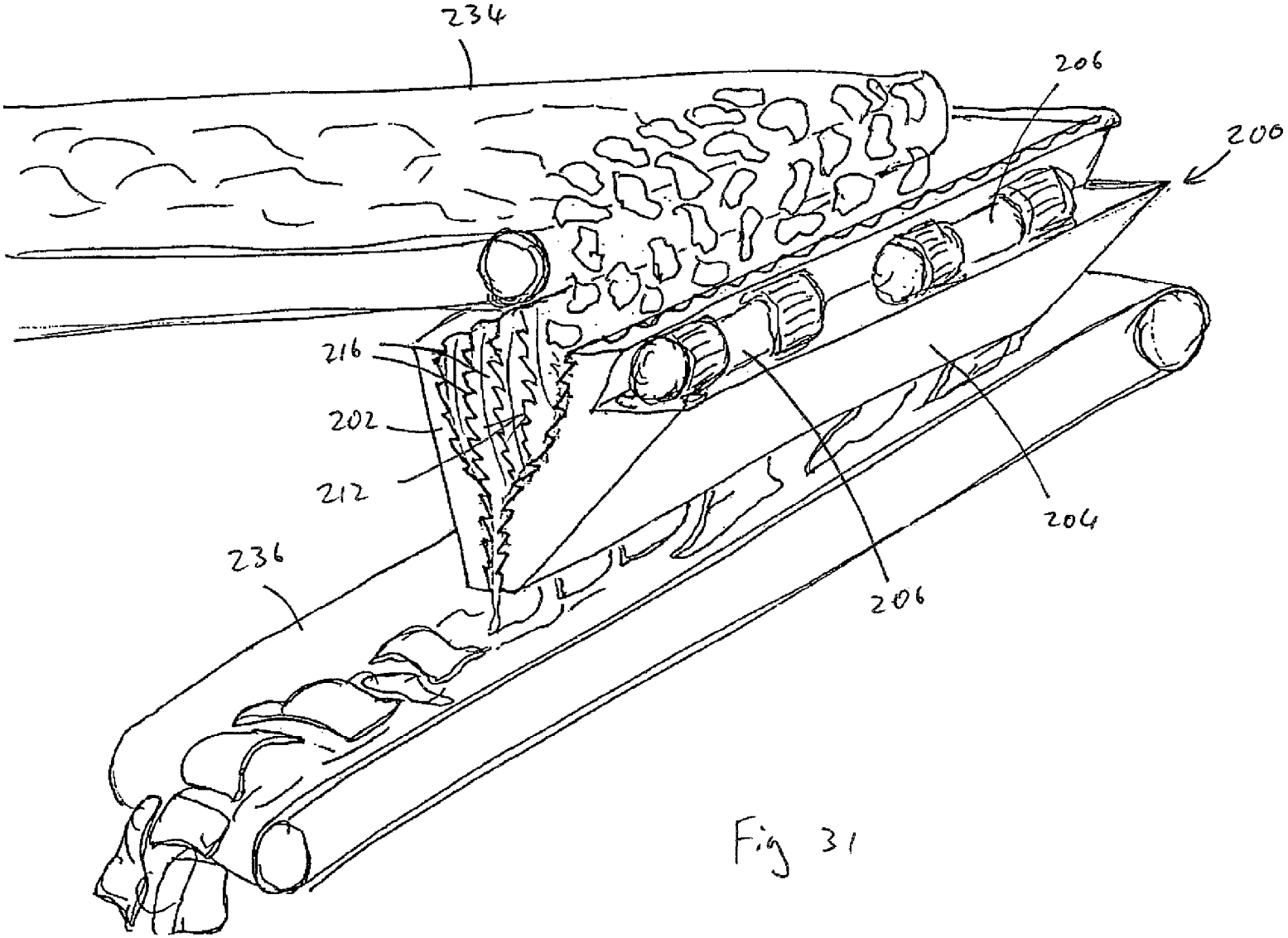
FIG. 31 shows a three dimensional view of a tenderiser in accordance with the present invention, with multiple vibrators.

Referring to FIG. 31, a tenderiser 200 is shown that is identical to that shown in the preceding drawings, except that it is much longer and has multiple vibrators 206. Meat chunks 220 are fed to its inlet 210 by a feeding conveyer belt 234 and tenderised meat, discharged from its outlet is removed by a despatching conveyor 236.

The tenderiser 200 can be configured to process various kinds of meat, e.g. it can be configured to:

The type of material passed through, i.e. the type of meat

The starting texture (i.e. toughness)

The heterogeneity of the starting texture (e.g. the inclusion of large sinews)

The desired final texture

This configuration includes adjustment of the angle and distance between the plates 202,204, as well as the manner and intensity of the vibrations.

The tenderiser can be used to process a variety of sized chunks 220, although it is preferable that the chunks have a fairly uniform size, e.g. chunks with a thickness of about 25 mm and with varying other dimensions, can be tenderised simultaneously.

The tenderiser 200 feeds automatically, so it need not be loaded at a predetermined rate, but can be bulk loaded or loaded continuously.

The tenderiser can be used to process even meats that are not tough, e.g. fish, to create sheets so that the meat fibres can be aligned prior to reconstitution. This allows the reconstituted product to have a natural appearance, rather than looking like chunks stuck together.

The tenderiser 200 can be used in large applications, e.g. in industry, but is also suitable to be used in smaller applications, e.g. in table top format.

The invention claimed is:

1. A static mixer comprising:

a plurality of wall elements, the wall elements being shaped and configured such that they define an internal passage, when placed in a side-by-side arrangement, said passage defining an inlet, an outlet and a flow path extending from the inlet, downstream towards the outlet; and a plurality of mixer elements, each attachable to the inside of one of the walling wall elements to protrude into the passage, each mixer element defining at least one leading surface facing towards the inlet of the passage and at least one trailing surface facing towards the outlet of the passage, each of the leading and trailing surfaces having a root where it meets the inside of the wall element to which it is attached and an apex, opposite from its root;

wherein the leading surface and the trailing surface intersect and are oriented at an angle greater than zero degrees relative to each other;

wherein each apex is spaced from adjacent mixer elements and from adjacent wall elements.

2. A static mixer as claimed in claim 1, wherein each of the leading surfaces and trailing surfaces intersect the inside of the wall element to which the element is attached, at an obtuse angle.

3. A static mixer as claimed in claim 1, wherein at least some of the mixer elements define a third surface extending in the direction of the flow path, giving said mixer element a three-dimensional triangular pyramid shape.

4. A static mixer as claimed in claim 3, wherein the third surface is generally aligned with a lateral edge of the wall element to which the mixer element is attachable.

5. A static mixer as claimed in claim 3, wherein the leading surface and third surface of at least some of the mixer elements intersect at an angle to form a sharp leading edge, facing towards the inlet of the passage.

6. A static mixer as claimed in claim 1, wherein at least one ridge is defined along an edge of the leading surface of at least some of the mixer elements, extending generally from its root in the direction of its apex.

7. A static mixer as claimed in claim 6, wherein at least one mixer element has two of said ridges and the ridges stop short of the apex to form an apex gap between them.

8. A static mixer as claimed in claim 7, wherein the ridges extend in a co-planar manner from at least one of the trailing surface and the third surface.

9. A static mixer as claimed in claim 7, wherein the leading surface is generally triangularly shaped and the two ridges converge towards the apex gap.

10. A static mixer as claimed according to claim 7, wherein the mixer elements are oriented such that the apex gaps of some mixer elements are immediately upstream of the leading surfaces of other mixer elements.

11. A method of treating food in a static mixer by passing a process stream along the internal passage of the mixer, wherein said static mixer comprises:

a plurality of wall elements, the wall elements being shaped and configured such that they define an internal passage, when placed in a side-by-side arrangement, said passage defining an inlet, an outlet and a flow path extending from the inlet, downstream towards the outlet; and a plurality of mixer elements, each attachable to the inside of one of the wall elements to protrude into the passage, each mixer element defining at least one leading surface facing towards the inlet of the passage and at least one trailing surface facing towards the outlet of the passage, each of the leading and trailing surfaces having a root where it meets the inside of the wall element to which it is attached and an apex, opposite from its root;

wherein the leading surface and the trailing surface intersect and are oriented at an angle greater than zero degrees relative to each other;

wherein each apex is spaced from adjacent mixer elements and from adjacent wall elements.

12. A method according to claim 11, which includes cleaving part of the process stream by passing it over a leading edge of one of the mixer elements.

13. A method according to claim 11, which includes cleaving part of the process stream by passing it over a ridge extending from an edge of one of the leading surfaces.

14. A method of treating food in a static mixer, wherein said static mixer comprises:

a plurality of wall elements, the wall elements being shaped and configured such that they define an internal passage, when placed in a side-by-side arrangement, said passage defining an inlet, an outlet and a flow path extending from the inlet, downstream towards the outlet; and a plurality of mixer elements, each attachable to the inside of one of the wall elements to protrude into the passage, each mixer element defining at least one leading surface facing towards the inlet of the passage and at least one trailing surface facing towards the outlet of the passage, each of the leading and trailing surfaces having a root where it meets the inside of the wall element to which it is attached and an apex, opposite from its root;

wherein the leading surface and the trailing surface intersect and are oriented at an angle greater than zero degrees relative to each other;

wherein each apex is spaced from adjacent mixer elements and from adjacent wall elements;

wherein at least one ridge is defined along an edge of the leading surface of at least some of the mixer elements, extending generally from its root in the direction of its apex;

wherein at least one mixer element has two of said ridges and the ridges stop short of the apex to form an apex gap between them;

said method comprising passing a process stream along the internal passage of the static mixer;

sliding part of the process stream along the leading surface of at least one of the mixer elements and compressing it between two converging ridges of the mixing element, before passing the compressed part of the process stream at least partly through the apex gap.

15. A method according to claim 14, which includes changing the direction of part of the process stream as it flows from the apex gap, by passing it over a leading surface of a mixer element immediately downstream.

* * * * *